US009961473B2

(12) United States Patent
Schlecht et al.

(10) Patent No.: US 9,961,473 B2
(45) Date of Patent: May 1, 2018

(54) APPARATUS AND METHOD FOR GENERATING OUTPUT SIGNALS BASED ON AN AUDIO SOURCE SIGNAL, SOUND REPRODUCTION SYSTEM AND LOUDSPEAKER SIGNAL

(71) Applicant: Fraunhofer-Gesellschaft zur Foerderung der angewandten Forschung e.V., Munich (DE)

(72) Inventors: Sebastian Schlecht, Leipzig (DE); Andreas Silzle, Buckenhof (DE); Emanuel Habets, Spardorf (DE); Christian Borss, Erlangen (DE); Bernhard Neugebauer, Buckenhof (DE); Hanne Stenzel, Neckarsulm (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days. days.

(21) Appl. No.: 15/585,792

(22) Filed: May 3, 2017

(65) Prior Publication Data

US 2017/0238119 A1 Aug. 17, 2017

Related U.S. Application Data

(63) Continuation of application No. PCT/EP2015/075141, filed on Oct. 29, 2015.

(30) Foreign Application Priority Data

Nov. 7, 2014 (EP) ..... 14192213

(51) Int. Cl.
*H04S 7/00* (2006.01)
*H04S 3/02* (2006.01)
(Continued)

(52) U.S. Cl.
CPC ..... *H04S 7/305* (2013.01); *G10K 15/10* (2013.01); *H04S 3/02* (2013.01); *G10K 15/12* (2013.01);
(Continued)

(58) Field of Classification Search
CPC ..... H04S 7/305; H04S 3/02; H04S 2420/03; H04S 2400/01; G10K 15/10
(Continued)

(56) References Cited

U.S. PATENT DOCUMENTS 5,491,751 A 2/1996 Paulson et al.
5,491,754 A 2/1996 Jot et al.
(Continued)

OTHER PUBLICATIONS

Dahl, Luke et al., "A Reverberator Based on Absorbent All-Pass Filters", Proceedings of the COST G-6 Conference on Digital Audio Effects (DAFX-00), Dec. 2000, 6 pages.
(Continued)

*Primary Examiner* — Melur Ramakrishnaiah
(74) *Attorney, Agent, or Firm* — Perkins Coie LLP; Michael A. Glenn

(57) ABSTRACT

An apparatus for generating a first multitude of output signals based on at least one audio source signal having a delay network and a feedback processor. The delay network includes a second multitude of delay paths, each delay path having a delay line and an attenuation filter. Each delay line is configured for delaying delay line input signals and for combining the at least one audio source signal and a reverberated audio signal to obtain a combined signal, wherein the attenuation filter of a delay path is configured for filtering the combined signal from the delay line of the delay path to obtain an output signal. The first multitude of output signals includes the output signal. The feedback processor is configured for reverberating the first multitude of output signals to obtain a third multitude of the reverberated audio signals including the reverberated audio signal.

32 Claims, 12 Drawing Sheets

(51) Int. Cl.
*G10K 15/10* (2006.01)
*G10K 15/12* (2006.01)

(52) U.S. Cl.
CPC ..... *H04S 2400/01* (2013.01); *H04S 2420/03* (2013.01)

(58) Field of Classification Search
USPC ..... 381/303, 309, 310, 17, 62–63, 97
See application file for complete search history.

(56) References Cited

U.S. PATENT DOCUMENTS 5,774,560 A * 6/1998 Su ..... G10K 15/12 381/63
8,204,240 B2 * 6/2012 Neunaber ..... H04S 1/002 381/63
8,363,843 B2 1/2013 Diedrichsen
2002/0067836 A1 6/2002 Paranjpe

OTHER PUBLICATIONS

Jot, Jean-Marc, "An Analysis/Synthesis Approach to Real-Time Artifical Reverberation", International Conference on Acoustics, Speech, and Signal Processing; ICASSP-92; vol. 2. IEEE, 1992, 4 pages.
Jot, Jean-Marc et al., "Digital Delay Networks for Designing Artifical Reverberators", Proceedings of the 90th AES Convention. Preprint 3030 (E-2), Feb. 1991, 18 pages.
Pulkki, Ville, "Virtual Sound Source Positioning Using Vector Vase Amplitude Panning", Journal of the Audio Engineering Society; vol. 45; No. 6, pp. 456-466, 1997, 11 pages.

* cited by examiner 1000
100
140
τ
early and late reverberation
170
172d
172a
104a
104b
118a
118b
104a'
104b'
122
104a''
104b''
172a
116
106a
106b
106c
106d
112a
112b
112c
112d
102a
102b
102c
102d
α1
α2
α3
α4
τ1
τ2
τ3
τ4
172b
172c
172d
108a
108b
108c
108d
114a
114b
114c
114d
A
120

$$A = \begin{bmatrix} U_1 & V_1 \\ V_2 & U_2 \end{bmatrix}$$

APPARATUS AND METHOD FOR GENERATING OUTPUT SIGNALS BASED ON AN AUDIO SOURCE SIGNAL, SOUND REPRODUCTION SYSTEM AND LOUDSPEAKER SIGNAL

CROSS-REFERENCE TO RELATED APPLICATIONS

This application is a continuation of copending International Application No. PCT/EP2015/075141, filed Oct. 29, 2015, which is incorporated herein by reference in its entirety, and additionally claims priority from European Application No. EP 14192213.8, filed Nov. 7, 2014, which is also incorporated herein by reference in its entirety.

The present invention relates to an apparatus for generating output signals based on at least one audio source signal, to an apparatus for generating a multitude of loudspeaker signals based on the at least one audio source signal, to a sound reproduction system, a method for generating the output signals and to a computer program. The present invention further relates to a loudspeaker signal and to techniques for spatial multichannel parametric reverberation.

BACKGROUND OF THE INVENTION

If sound is emitted in a room, the sound waves travel across the space until they are reflected at the room boundaries. The reflections are again rebounded and over time a more and more complex pattern of sound waves evolves, the so-called reverberation. FIG. 8 shows a schematic single channel representation of reverberation which is an impulse response of a typical room with direct sound 1002, early reflections 1004 and late reverberation 1006. At a receiver position and as depicted at the abscissa of FIG. 8, first the direct sound 1002 is received from the receiver. The direct sound 1002 travels unreflectedly to the receiver. Afterwards, the early reflections 1004 are received. The early reflections 1004 consist of a number of distinct reflections, which over time condense to the late reverberation 1006. The direct sound 1002 and the earlier reflections 1004 are particularly dependent on the source and the receiver positions relative to the room geometry. The reflections in the late reverberation 1006 are characterized by being equally distributed in direction and relatively independent of the source and receiver positions.

However, in spatial reproduction every sound has a direction of arrival (DOA), i.e., the sound arrives from a certain angular direction given by azimuth and elevation. For a better illustration, FIG. 9 shows a schematic spatial representation of reverberation in only two dimensions. The DOA is clearly perceivable for the direct sound 1002 and determines mainly the source localization. The DOA is also important for the early reflections 1004 as it helps to create a sense of room geometry, spatial depth of the source and angular source localization. The late reverberation 1006 is diffuse and no explicit DOA can be perceived.

With an increase of time t, depicted at the abscissa, the receiver first perceives direct sound 1002 and afterwards the early reflections 1004 followed by late reverberation 1006. An angular direction is the azimuth angle of the direction of arrival of the sound wave, the azimuth angle depicted as radial dimension. The distance to the receiver is the time of arrival. The darkness of the points depicts the level of perceived level of reflection. Thus, FIG. 9 depicts a spatial representation of reverberation in two dimensions.

In the course of audio postproduction, artificial reverberation is added to the sound to enhance the spatial quality. The desired objectives range from enhancement of the musicality, improvement of the sound design to recreation of a physical acoustic space. A realistic acoustic space can be created by the use of multiple loudspeakers, source dependent early reflections and uncorrelated late reverberation. In this sense, it is referred to multichannel as having a high number of audio sources and a high number of output channels.

Practical reverberation algorithms generally fall into one of two categories, although hybrids exist:

1) delay networks, in which the input signal is delayed, filtered and fed back;

2) convolutional, wherein the input signal is simply convolved with a recorded or estimated impulse response of an acoustic space.

Convolutional reverberators reproduce a given acoustics with high precision, but also with high computational costs, i.e., efforts. Multichannel convolutional reverberators have been devised, but the computational costs scale linearly with the number of source and channel pairs.

For low channel applications, i.e., mono and stereo, a wide variety of parametric reverberators was developed. None of these developments, however, have been extended in an efficient manner to a high multichannel reverberator. In particular, they lack flexibility in coping with arbitrary source inputs and loudspeaker setups.

Many artificial reverberators have been developed in recent years, wherein in the following a brief overview of their application in multichannel reverberation is given. The vast majority of the commercially available reverberators have a low number of input and output channels. Whereas they have developed a high standard in usability, computational efficiency and sound quality, they scale inefficiently for high numbers of output channels.

One way to achieve a high number of channels using low channel reverberators is to instantiate multiple similar reverberators. This increases the memory requirements and computational costs considerably. For uncorrelated output channels the reverberators are parameterized differently, so they might become distinctive. It is possible to overcome distinctly receivable reverberators by cross-feeding signals between the reverberators.

However, the DOA of the early reflections cannot be implemented in this way as the desired DOA might be between the output channel of two reverberators. Consequently, there is no explicit way to position multiple sources by the means of the combination of multiple reverberators. Further, the usability for multiple instances can become awkward and complicated.

While convolution-based reverberators can produce a given physical acoustic space with high precision, as it is described, for example, in [1], they scale very inefficiently with a high number of sound sources and output channels. Each pair of sound source and output channel is processed by a separate convolution. Consequently, the number of convolutions to be performed is the product of the number of sound sources and output channels. The impulse responses are difficult to acquire and they lack flexibility in the source and receiver positioning of other room parameters.

In contrast, delay networks-based reverberators allow a wide control over any detail of the reverberated sound. Also, recently delay networks reverberators developed a high standard of sound quality in low channel applications.

Currently existing algorithms do not or inefficiently offer a consistent approach to recreate multichannel audio with high efficiency.

Typically, the reverberation is created in two stages: the early reflections and the late reverberation as it is depicted in FIG. 10 and described in [2,3]. The early reflections 1004 and 1004 are delayed (1008*a* and 1008*b*) and attenuated (1012*a* and 1012*b*) copies of the monaural source 1014*a* and 1014*b*. The delay lines 1008*a* and 1008*b*, labeled as $T_{si}$, the outtap gains 1012*a* and 1012, labeled as $b_{si}$ and the panning 1016 are dependent on the source position and are exclusive to each source. Hence, for every source 1014*a* and 1014*b*, the early reflection section 1018 has to be duplicated. To enhance the quality of the early reflections 1004*a* and 1004*b*, they are processed by a diffusor unit 1022. The diffusor 1022 is typically implemented as an allpass filter or a short finite impulse response (FIR) filter to emulate the effect of non-specular wall reflections. The particular order and replacement of the diffusor 1022 and panning 1016 units can vary, e.g. for accurate panning of every single early reflection 1004*a* and 1004*ba* dedicated panning unit 1016 for each source 1014*a* and 1014*b* can be employed or the diffusor 1022 can be placed directly at the source input of the delay line 1008*a* and 1008*b*. Hence, the particular design is a tradeoff between detailed control and computational efficiency.

The late reverberation is created by the feedback delay network (FDN) 1024. The FDN 1024 is based around a set of N delay lines 1025, labeled as $\tau 1$, $\tau 2$, . . . , $\tau N$ and a feedback mixing matrix A to evolve a complex echo pattern over time. The reverberation time and diffusion is controlled by the attenuation filters 1026, labeled as $\alpha 1$, $\alpha 2$, . . . , $\alpha N$. The implementation of the attenuation filters ranges from a simple lowpass filter, as it is described in [4] to absorbent allpass filters as it is described in [5].

The early reflections are fed into the FDN loop to increase initial density of the delayed reverberation. Delayed reverberation is mixed and added to the panned early reflections. The resulting channels are fed into the loudspeakers 1028 of the reproduction room 1032. Optionally, a channel-dependent equalization filter (EQ) 1034 can be applied to the speaker channels for spectral corrections and speaker dependent frequency response.

In the listening position, all output channels in the reproduction room 160 are delayed and summed up and form the receiver signal. Hence, premixing of the delay line signals as it is typically performed in the prior design, increases the echo density in every output channel, but does not increase the echo density perceived in the room. It rather tends to introduce unpleasant coherence and comb-like filter artifacts. One extreme example, which may occur with a Hadamard mixing matrix, is to distribute the output of a delay line to all output channels, which creates a multichannel mono signal with a phase flip.

Designs of known concepts have no efficient and convenient way to handle multichannel reverberation including spatial cues and direction-dependency. Further, early reflections, which are most important for the spatial perception of the reverberator are rendered separately by known concepts, what is computational costly.

Currently, many different multi-speaker configurations exist, meaning that multichannel reverberations with flexible speaker configurations are highly necessitated. Hence, for example, there is a need for audio reproduction concepts, allowing for multichannel reverberators with a more flexible speaker configuration and/or for an efficient way for obtaining the reverberations.

SUMMARY

According to an embodiment, an apparatus for generating a first multitude of output signals based on at least one audio source signal may have: a delay network including a second multitude of delay paths each delay path having a delay line and an attenuation filter, each delay line being configured for delaying delay line input signals and for combining the at least one audio source signal and a reverberated audio signal to obtain a combined signal, wherein the attenuation filter of a delay path is configured for filtering the combined signal from the delay line of the delay path to obtain an output signal, wherein the first multitude of output signals includes the output signal; and a feedback processor configured for reverberating the first multitude of output signals to obtain a third multitude of the reverberated audio signals including the reverberated audio signal; wherein the combined signal includes an audio source signal portion and a reverberated signal portion and wherein the delay line includes a sixth multitude of input taps being configured for receiving the audio source signal or a weighted version of the audio source signal, wherein the apparatus includes an input controller configured for connecting the audio source signal or the weighted version of the audio source signal and one of the sixth multitude of input taps and based on a first position of a virtual audio source in a virtual reproduction room and while not connecting the audio source signal or the weighted version of the audio source signal to a different input tap of the sixth multitude of input taps, and wherein the input controller is configured for disconnecting the audio source signal or the weighted version of the audio source signal from the one of the sixth multitude of input taps based on a second position of the virtual audio source, the second position being different from the first position; or wherein the combined signal includes an audio source signal portion and a reverberated signal portion and wherein the delay line includes a seventh multitude of output taps being configured for providing the combined signal or an intermediate delay line signal, wherein the apparatus includes an output controller configured for connecting an equalization filter to the output signal or top one of the seventh multitude of output taps based on a first reflection characteristic of a virtual reproduction room, while not connecting a different output tap of the seventh multitude of output taps to the equalization filter, and wherein the output controller is configured for disconnecting the equalization filter from the output signal or from the intermediate delay line signal based on a second reflection characteristic of the virtual production room being different from the first characteristic.

According to another embodiment, an apparatus for generating a fourth multitude of loudspeaker signals based on at least one audio source signal may have: a delay network including a second multitude of delay paths each delay path having a delay line and an attenuation filter, each delay line being configured for delaying delay line input signals and for combining the at least one audio source signal and a reverberated audio signal to obtain a combined signal, wherein the attenuation filter of a delay path is configured for filtering the combined signal from the delay line of the delay path to obtain an output signal, wherein the first multitude of output signals includes the output signal; and a feedback processor configured for reverberating the first multitude of output signals to obtain a third multitude of the reverberated audio signals including the reverberated audio signal; wherein the delay network includes a fifth multitude of equalization filters being configured for spectrally shaping the first multitude of output signals or intermediate delay line signals to obtain the fourth multitude of loudspeaker signals, the intermediate delay line signals being received from an output tap of the delay line.

According to another embodiment, a sound reproduction system may have: an inventive apparatus for generating a first multitude of output signals; an eleventh multitude of loudspeakers; and a panner configured for receiving a fourth multitude of loudspeaker signals derived from the first multitude of output signals and for panning the fourth multitude of loudspeaker signals to a twelfth multitude of panned loudspeaker signals, the twelfth multitude of panned loudspeaker signals having a number of loudspeaker signals that is equal to a number of loudspeakers of the eleventh multitude of loudspeakers; wherein the panner is configured for maintaining a sound propagation characteristic of a virtual reproduction room associated to the fourth multitude of loudspeaker signals when panning the fourth multitude of loudspeaker signals.

According to another embodiment, a sound reproduction system may have: an inventive apparatus for generating a fourth multitude of loudspeaker signals; an eleventh multitude of loudspeakers; and a panner configured for receiving a fourth multitude of loudspeaker signals derived from the first multitude of output signals and for panning the fourth multitude of loudspeaker signals to a twelfth multitude of panned loudspeaker signals, the twelfth multitude of panned loudspeaker signals having a number of loudspeaker signals that is equal to a number of loudspeakers of the eleventh multitude of loudspeakers; wherein the panner is configured for maintaining a sound propagation characteristic of a virtual reproduction room associated to the fourth multitude of loudspeaker signals when panning the fourth multitude of loudspeaker signals.

According to another embodiment, a method for generating a first multitude of output signals based on at least one audio source signal may have the steps of: delaying and combining the at least one audio source signal and a reverberated audio signal with a delay line to obtain a combined signal; filtering the combined signal from the delay line to obtain an output signal, wherein the first multitude of output signals is obtained from a second multitude of delay paths each delay path having a delay line; and reverberating the first multitude of output signals to obtain a third multitude of the reverberated audio signals including the reverberated audio signal; wherein the combined signal includes an audio source signal portion and a reverberated signal portion and wherein the delay line includes a sixth multitude of input taps being configured for receiving the audio source signal or a weighted version of the audio source signal, the method having the steps of: connecting the audio source signal or the weighted version of the audio source signal and one of the sixth multitude of input taps and based on a first position of a virtual audio source in a virtual reproduction room and while not connecting the audio source signal or the weighted version of the audio source signal to a different input tap of the sixth multitude of input taps, and disconnecting the audio source signal or the weighted version of the audio source signal from the one of the sixth multitude of input taps based on a second position of the virtual audio source, the second position being different from the first position; or or wherein the combined signal includes an audio source signal portion and a reverberated signal portion and wherein the delay line includes a seventh multitude of output taps being configured for providing the combined signal or an intermediate delay line signal, the method having the steps of connecting an equalization filter to the output signal or top one of the seventh multitude of output taps based on a first reflection characteristic of a virtual reproduction room, while not connecting a different output tap of the seventh multitude of output taps to the equalization filter, and disconnecting the equalization filter from the output signal or from the intermediate delay line signal based on a second reflection characteristic of the virtual production room being different from the first characteristic.

According to another embodiment, a method for generating a fourth multitude of loudspeaker signals based on at least one audio source signal may have the steps of: delaying and combining the at least one audio source signal and a reverberated audio signal with a delay line to obtain a combined signal; filtering the combined signal from the delay line to obtain an output signal, wherein the first multitude of output signals is obtained from a second multitude of delay paths each delay path having a delay line; and reverberating the first multitude of output signals to obtain a third multitude of the reverberated audio signals including the reverberated audio signal; spectrally shaping the first multitude of output signals or intermediate delay line signals to obtain the fourth multitude of loudspeaker signals, the intermediate delay line signals being received from an output tap of the delay line; wherein the combined signal includes an audio source signal portion and a reverberated signal portion and wherein the delay line includes a sixth multitude of input taps being configured for receiving the audio source signal or a weighted version of the audio source signal, the method having the steps of: connecting the audio source signal or the weighted version of the audio source signal and one of the sixth multitude of input taps and based on a first position of a virtual audio source in a virtual reproduction room and while not connecting the audio source signal or the weighted version of the audio source signal to a different input tap of the sixth multitude of input taps, and disconnecting the audio source signal or the weighted version of the audio source signal from the one of the sixth multitude of input taps based on a second position of the virtual audio source, the second position being different from the first position; or or wherein the combined signal includes an audio source signal portion and a reverberated signal portion and wherein the delay line includes a seventh multitude of output taps being configured for providing the combined signal or an intermediate delay line signal, the method having the steps of connecting an equalization filter to the output signal or top one of the seventh multitude of output taps based on a first reflection characteristic of a virtual reproduction room, while not connecting a different output tap of the seventh multitude of output taps to the equalization filter, and disconnecting the equalization filter from the output signal or from the intermediate delay line signal based on a second reflection characteristic of the virtual production room being different from the first characteristic.

Another embodiment may have a non-transitory digital storage medium having a computer program stored thereon to perform the method for generating a first multitude of output signals based on at least one audio source signal, the method having the steps of: delaying and combining the at least one audio source signal and a reverberated audio signal with a delay line to obtain a combined signal; filtering the combined signal from the delay line to obtain an output signal, wherein the first multitude of output signals is obtained from a second multitude of delay paths each delay path having a delay line; and reverberating the first multitude of output signals to obtain a third multitude of the reverberated audio signals including the reverberated audio signal; wherein the combined signal includes an audio source signal portion and a reverberated signal portion and wherein the delay line includes a sixth multitude of input taps being configured for receiving the audio source signal or a weighted version of the audio source signal, the method having the steps of: connecting the audio source signal or the weighted version of the audio source signal and one of the sixth multitude of input taps and based on a first position of a virtual audio source in a virtual reproduction room and while not connecting the audio source signal or the weighted version of the audio source signal to a different input tap of the sixth multitude of input taps, and disconnecting the audio source signal or the weighted version of the audio source signal from the one of the sixth multitude of input taps based on a second position of the virtual audio source, the second position being different from the first position; or or wherein the combined signal includes an audio source signal portion and a reverberated signal portion and wherein the delay line includes a seventh multitude of output taps being configured for providing the combined signal or an intermediate delay line signal, the method having the steps of connecting an equalization filter to the output signal or top one of the seventh multitude of output taps based on a first reflection characteristic of a virtual reproduction room, while not connecting a different output tap of the seventh multitude of output taps to the equalization filter, and disconnecting the equalization filter from the output signal or from the intermediate delay line signal based on a second reflection characteristic of the virtual production room being different from the first characteristic, when said computer program is run by a computer.

Another embodiment may have a non-transitory digital storage medium having a computer program stored thereon to perform the method for generating a fourth multitude of loudspeaker signals based on at least one audio source signal, the method having the steps of: delaying and combining the at least one audio source signal and a reverberated audio signal with a delay line to obtain a combined signal; filtering the combined signal from the delay line to obtain an output signal, wherein the first multitude of output signals is obtained from a second multitude of delay paths each delay path having a delay line; and reverberating the first multitude of output signals to obtain a third multitude of the reverberated audio signals including the reverberated audio signal; spectrally shaping the first multitude of output signals or intermediate delay line signals to obtain the fourth multitude of loudspeaker signals, the intermediate delay line signals being received from an output tap of the delay line; wherein the combined signal includes an audio source signal portion and a reverberated signal portion and wherein the delay line includes a sixth multitude of input taps being configured for receiving the audio source signal or a weighted version of the audio source signal, the method having the steps of: connecting the audio source signal or the weighted version of the audio source signal and one of the sixth multitude of input taps and based on a first position of a virtual audio source in a virtual reproduction room and while not connecting the audio source signal or the weighted version of the audio source signal to a different input tap of the sixth multitude of input taps, and disconnecting the audio source signal or the weighted version of the audio source signal from the one of the sixth multitude of input taps based on a second position of the virtual audio source, the second position being different from the first position; or or wherein the combined signal includes an audio source signal portion and a reverberated signal portion and wherein the delay line includes a seventh multitude of output taps being configured for providing the combined signal or an intermediate delay line signal, the method having the steps of connecting an equalization filter to the output signal or top one of the seventh multitude of output taps based on a first reflection characteristic of a virtual reproduction room, while not connecting a different output tap of the seventh multitude of output taps to the equalization filter, and disconnecting the equalization filter from the output signal or from the intermediate delay line signal based on a second reflection characteristic of the virtual production room being different from the first characteristic, when said computer program is run by a computer.

Another embodiment may have a loudspeaker signal obtained by an inventive apparatus for generating a first multitude of output signals.

Another embodiment may have a loudspeaker signal obtained by an inventive apparatus for generating a fourth multitude of loudspeaker signals.

Embodiments of the present invention related to an apparatus for generating a first multitude of output signals based on at least one audio source signal. The apparatus comprises a delay network and a feedback processor. The delay network comprises a second multitude of delay paths, wherein each delay path comprises a delay line and an attenuation filter. Each delay line is configured for delaying input signals of the delay line and for combining the at least one audio source signal and a reverberated audio signal to obtain a combined signal. The attenuation filter of the delay path is configured for filtering the combined signal from the delay line of the delay path to obtain an output signal. The first multitude of output signals comprises the output signal. The feedback processor is configured for reverberating the first multitude of output signals to obtain a third multitude of the reverberated audio signals comprising the reverberated audio signal.

This allows for obtaining delayed (early reflections) and reverberated signals from one FDN, wherein a complexity of the FDN may be almost independent from a number of source signals such that the delayed and reverberated signals are obtained efficiently.

Further embodiments of the present invention relate to an apparatus for generating a fourth multitude of loudspeaker signals based on at least one audio source signal. The apparatus comprises a delay network and a feedback processor. The delay network comprises the second multitude of delay paths, wherein each delay path comprises a delay line and an attenuation filter. Each delay line is configured for delaying delay line input signals and for combining the at least one audio source signal and a reverberated audio signal to obtain a combined signal. The attenuation filter of a delay path is configured for filtering the combined signal from the delay line of the delay path to obtain an output signal. The first multitude of output signals comprises the output signal. The feedback processor is configured for reverberating the first multitude of output signals to obtain a third multitude of the reverberated audio signals comprising the reverberated audio signal. The delay network further comprises a fifth multitude of equalization filters being configured for spectrally shaping the first multitude of output signals or intermediate delay line signals to obtain the fourth multitude of loudspeaker signals. The intermediate delay line signals are received from an output tap of the delay line.

It has been found by the inventors that by combining the audio source signal and reverberated audio signals in a delay line both, the earlier reflections and the late reverberation may be obtained by a feedback delay network. A computational complexity of the proposed concept scales with a number of output signals or loudspeaker signals to be obtained but may be independent or almost independent from a number of audio source signals to be rendered into the output signals, the loudspeaker signals respectively. Further, a spatial information of reflected and/or reverberated audio signals may be maintained.

Further embodiments of the present invention relate to a sound reproduction system comprising an apparatus for generating a first multitude of output signals or an apparatus for generating a fourth multitude of loudspeaker signals, a multitude of loudspeakers and a panner configured for receiving loudspeaker signals derived from the output signal and for panning the loudspeaker signals to a multitude of loudspeaker signals that correspond to a number of loudspeakers which may be different from a number of received loudspeaker signals. The panner is configured for maintaining a sound propagation characteristic of a virtual reproduction room associated with the multitude of received loudspeaker signals when panning the received signals to the panned loudspeaker signals.

This allows for a flexible loudspeaker configuration, independent from the generated output signals or loudspeaker signals of the apparatus as those signals may comprise directional information related to the delay lines of the apparatus for generating the output signals or the loudspeaker signals such that those spatial information may be maintained.

Further embodiments of the present invention relate to a method for generating a first multitude of output signals, a method for generating a multitude of loudspeaker signals, to a computer program and to a loudspeaker signal.

BRIEF DESCRIPTION OF THE DRAWINGS

Embodiments of the present invention will be detailed subsequently referring to the appended drawings, in which.

DETAILED DESCRIPTION OF THE INVENTION

Figures 1, 1A, 1B:
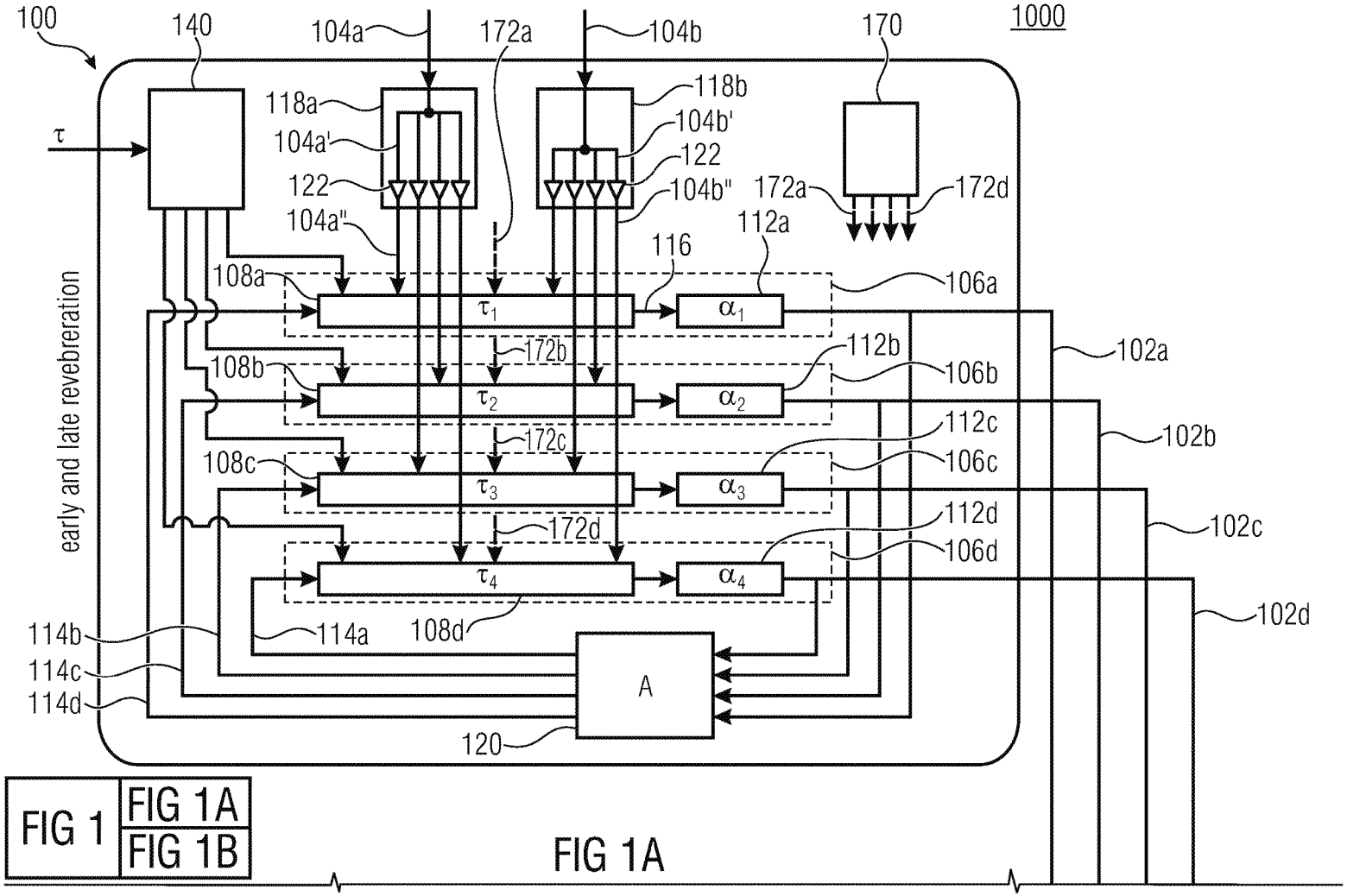
FIGS. 1*a-b* shows a schematic block diagram of a sound reproduction system comprising an apparatus for generating a multitude of output signals based on two audio source signals according to an embodiment.
Figure 1B:
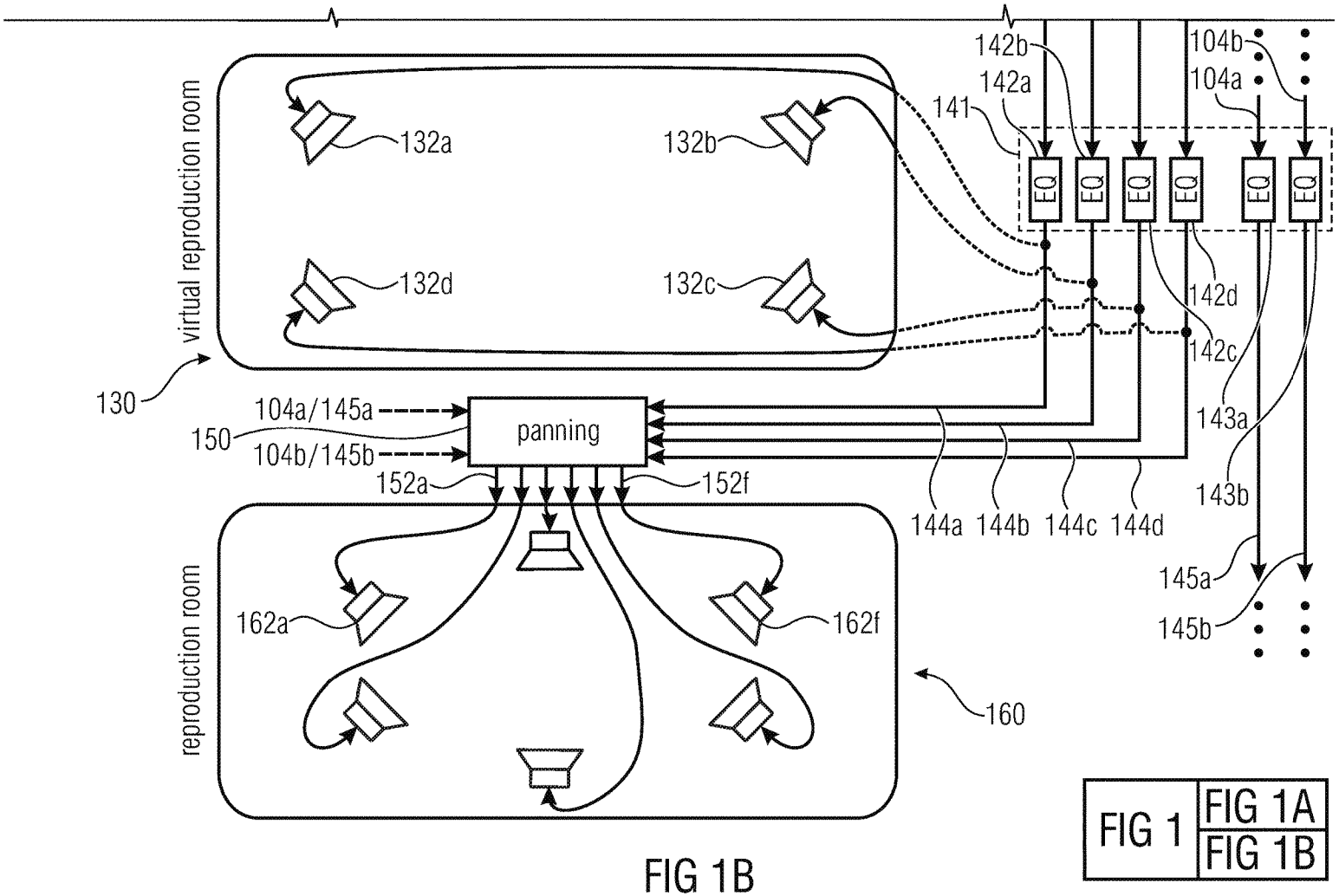

Equal or equivalent elements or elements with equal or equivalent functionality are denoted in the following description by equal or equivalent reference numerals even if occurring in different figures.

In the following description, a plurality of details is set forth to provide a more thorough explanation of embodiments of the present invention. However, it will be apparent to those skilled in the art that embodiments of the present invention may be practiced without these specific details. In other instances, well known structures and devices are shown in block diagram form rather than in detail in order to avoid obscuring embodiments of the present invention. In addition, features of the different embodiments described hereinafter may be combined with each other, unless specifically noted otherwise.

FIG. 1 shows a schematic block diagram of a sound reproduction system 1000 comprising an apparatus 100 for generating a multitude of output signals 102*a-d* based on two audio source signals 104*a* and 104*b*. The audio source signals may be, for example, a mono signal and may be associated with a virtual audio object, i.e., a virtual audio source adapted to emit a mono signal.

The apparatus 100 is configured for generating the output signals 102*a-d* based on the audio source signals 104*a* and 104*b* such that the output signals 102*a-d* are reflected and/or reverberated versions of the audio source signals 104*a* and 104*b*, i.e., the output signals 102*a-d* are derived from the audio source signals 104*a* and 104*b*. An information carried by the output signal 102*a-d* may vary over time. For example, the output signal may be an early reflection of the audio source signal in a virtual reproduction room 130 at a first time instance and a reverberated version of the audio source signal at a second time instance following the first time instance.

The apparatus 100 comprises four delay lines 106*a-d*. Each delay path 106*a-d* comprises a delay line 108*a-d* and an attenuation filter 112*a-d*. The delay lines 108*a-d* are configured for receiving the audio source signals 104*a* and 104*b* and a reverberated audio signal 114*a-d*, i.e., every delay line 108*a-d* is configured for receiving three signals, two audio source signals and one reverberated audio signal.

As it will be described later and in more detail, every delay line 108*a-d* is configured for delaying a received (input) signal and for combining the received and delayed signal such that a combined signal 116 is obtained. The combined signal 116 comprises, e.g. by a different time delay, delayed portions of the audio source signals 104*a* and 104*b* and of the reverberated signal 114*a*, 114*b*, 114*c* or 114*c*. The delay lines 108*a-d* are depicted as schematic blocks labeled as τ1-τ4. Schematically, the delay lines 104*a-d* may be understood as delaying filters, such as an finite impulse response (FIR) filter transferring a received signal from one direction, e.g., left, to another direction, e.g., right of the schematic filter structure. Simplified, the more "left" a signal is input into the delay line, the more it is delayed. When referring to the delay line 108*a*, the audio source signal 104*a* is delayed by a greater time delay than the audio source signal 104*b* and the reverberated audio signal 114*a* is delayed by a longer time duration than the audio source signal 104*a*.

The delay paths 106*a-d* each comprise the attenuation filter 112*a-d* labeled as al, a2, a3, a4, respectively. The attenuation filters 116 are configured for providing, i.e., to output, the output signals 102*a-d* by attenuating the combined signal 116 of the delay line 108*a-d* and may be implemented, for example as infinite impulse response (IIR) filters. By combining the audio source signal 104*a* and 104*b* in a delay line 108*a-d* and by attenuating the combined signal 116, early reflections of the audio source signals 104*a* and 104*b* may be obtained.

The apparatus 100 further comprises a feedback processor 120 configured for reverberating the output signals 102*a-d* such that the reverberated audio signals 114*a-d* are obtained. The feedback processor 120 may be understood, for example, as cross-feeding the output signals 102*a-d*. The cross-feeding may be depicted, for example, as a matrix operation. The delay paths may form a delay network. The feedback processor 120 and the delay network may form a feedback delay network (FDN), wherein the feedback processor 120 is configured for performing a feedback and/or a cross-feeding of the output signals 102 to the delay network.

The apparatus 100 comprises two distributors 118*a* and 118*b*, wherein the distributor 118*a* is configured for receiving the audio source signal 104*a* and wherein the distributor 118*b* is configured for receiving the audio source signal 104*b*. The distributors 118*a* and 118*b* are configured for distributing the received audio source signal 104*a* or 104*b* into a number of versions (copies) thereof. Simplified, the distributor 118*a* and 118*b* are configured for splitting or copying the received audio source signal 104*a* or 104*b*. The obtained versions 104*a*', 104*b*' may comprise no or a low delay with respect to each of the other versions of the respective audio source signal 104*a* or 104*b*. A low delay may be, for example, lower than or equal than 20%, than 10% or than 4% of a maximum time delay of the delay lines 108*a-d*. The distributors 118*a* and 118*b* further comprise a plurality or a multitude of amplifiers 122 configured for individually amplifying or attenuating the versions 104*a*', 104*b*' respectively. the applied gain or attenuation may be correlated, for example, to a strength or a value of the reflection of the sound source in the virtual reproduction room.

The distributor 118*a* is configured for providing a number of individually, i.e., independent from each other, amplified versions 104*a*" of the audio source signal 104*a*, wherein a number of the versions 104*a*" may be equal to a number of delay paths 106*a-d* such that each delay line 108*a-d* may receive one of the versions 104*a*". The distributor 118*b* may comprise a multitude of amplifiers 122 configured for independently amplifying the versions 104*b*' to obtain a number of independently amplified versions 104*b*" of the audio source signal 104*b*, wherein a number of the obtained versions 104*b*" or 104*b*' may be equal to the number of delay lines 108*a-d* such that every delay line 108*a-d* may receive one of the amplified versions 104*b*". As each delay line 106*a-d* may be associated with a virtual loudspeaker, a gain of each of the amplifiers 122 may influence a characteristic of the reproduced reflection of the sound object reproduced in the virtual reproduction room and reflected at a sound reflecting structure such as a wall.

The versions (copies) and the amplified versions of the audio source signal 104*a* and 104*b* carry an unchanged information with respect to the mono signal, i.e., to the audios source signal 104*a* and 104*b*. In terms of the further processing for delaying, attenuating and the like, those signals may be regarded as unchanged.

The structure of the apparatus 100 allows for, over time, that each output signal 102*a-d* comprises a reflected and a reverberated portion of the audio source signals 104*a* and 104*b* as it will be described in the following example:

The delay line 108*a* is configured for receiving the audio source signal 104*a*, an amplified version 104*a*" thereof respectively, and an amplified version 104*b*" of the audio source signal 104*b*. The audio source signal 104*b* is delayed by a shorter time delay than the audio source signal 104*a* as it is indicated by the input of the audio source signal 104*b* being arranged closer to the output of the delay line 108*a* when compared to the input of the audio source signal 104*a*. For example, when the delay line 108*a* comprises a plurality of delay blocks, the audio source signal 104*a* may be delayed by a higher number of delay blocks when compared to the audio source signal 104*b*. The combined signal 116 thus comprises a portion derived from the delayed audio source signal 104*b* and a portion of the audio source signal 104*b* which is delayed for a longer time. The combined signal 116 is provided to the attenuation filter 112*a*. The output signal 102*a* may be described as a delayed and attenuated and thus reflected version of the audio source signals 104*a* and 104*b*.

As indicated by the inputs at different actual positions and therefore time delays of the delay lines 108*a-d*, the inputs receiving the audio source signals 104*a* and 104*b*, the amplified versions 104*a*" and 104*b*" respectively, each version 104*a*" may be delayed by a different time delay when compared to other delay lines 108*a-d*. Accordingly, each version 104*b*" of the audio source signal 104*b* may be delayed by a different time delay when compared to the other delay lines 108*a-d*. Thus, a multitude of reflected signals may be obtained.

The output signals 102*a-d* are reverberated by the feedback processor 120 and then provided to the delay paths 106*a-d*. The reverberated signals 114*a-d* are delayed by the delay lines 108*a-d* and combined with the audio source signals 104*a* and 104*b*. This allows for obtaining reverberated portions in the output signals 102*a-d*.

Further audio source signals may be fed into the delay network, i.e., into the plurality of delay paths 106*a-d*. A processing of the further audio source signals may be obtained without a further arrangement of delay paths and thus without providing extra memory or filter stages. Alternatively, only one audio source signal may be processed, i.e., delayed and reverberated.

A time delay of the audio source signal 104*a* and 104*b*, i.e., a position of the signal input with respect to the delay line 108*a-d* may be adjusted or set according to a position of a virtual loudspeaker 132*a-d* in a virtual reproduction room 130. The virtual reproduction room 130 may be parameterized as a reference scene in which audio objects shall be reproduced or generated. The virtual loudspeakers 130*a-d* are arranged at virtual positions in the virtual reproduction room and comprise virtual radiation characteristics, such as a direction and/or a radiation pattern. The position and/or direction of sound propagation of the virtual loudspeakers 132*a-d* (the direction of sound arrival) in the virtual reproduction room 130 are related (parameterized) by the FDN, by the delay lines 108*a-d* respectively. Simplified, the virtual reproduction room 130 may be used to acquire the parameters for the delay lines 108*a-d*, the attenuation filters 112*a-d* and the feedback processor 120.

A delay time of a delay line 108*a-d* may correspond to a distance of a virtual loudspeaker 132*a-d* to a sound reflecting structure of the virtual reproduction room. A reverberation time of the virtual reproduction room may correspond to attenuation factors of the attenuation filters 112*a-d*. The attenuation factors of the attenuation filters 112*a-d* and/or the reverberation time may be frequency dependent, i.e., a first frequency may be reverberated with a first reverberation time, different from a second reverberation time by which a second frequency, different from the first frequency, is reverberated. For example, the higher the attenuation is, the shorter a reverberation time may be. Thus, the filter coefficients of the attenuation filters 112*a-d* may be related to a reverberation time of the audio source signal with respect to the virtual reproduction room 130. The filter coefficients may be time variant, e.g., based on a time variant virtual reproduction room 130.

Thus, the virtual loudspeakers 132*a-d* are associated with an information comprising a virtual direction of sound propagation in the virtual reproduction room 130. Each virtual loudspeaker 132*a-d* may be adjusted independently with respect to other virtual loudspeakers 132*a-d*. By varying a time delay of the delay line 108*a-d*, a position of a corresponding virtual loudspeaker 132*a-d* in the virtual reproduction room 130 may be influenced or vice versa. Thus, the virtual loudspeaker setup may be realized in any desired form, for example, the virtual loudspeakers 132*a-d* may be distributed equally in the virtual reproduction room 130. Alternatively, the virtual loudspeakers 132*a-d* may be distributed unequally, for example and with respect to a position of a listener, a left, right, front or back area of the listener may comprise a higher density of loudspeakers when compared to other sections of the virtual reproduction room 130.

A floor, a ceiling, walls and/or other sound reflecting objects may also be parameterized by or in the virtual reproduction room. Thus, a virtual sound object emitting a sound in the virtual reproduction room with a sound propagation characteristic, such as a direction, may be reproduced by the virtual loudspeakers 130*a-d*. Sound propagation characteristics of the virtual reproduction room, such as sound reflections and/or sound attenuation at walls or the like may be transferred at least partially into parameters of the delay network. For example, a distance between a virtual loudspeaker and a wall of the virtual reproduction room may be transferred in a time of travel (time delay) before the sound wave is reflected. The time delays of the delay lines 108*a-d* may refer to a delay of a propagated sound in the virtual reproduction room before arriving at a virtual listening position. Each delay path 106*a-d* may be related to a virtual loudspeaker 130*a-d* in the virtual reproduction room 130. This allows for a scaling of the apparatus 100 based on a number of virtual loudspeakers 130*a-d* instead of based on a number of reproduced sound sources.

Based on a variable position of a virtual audio source in the virtual reproduction room 130 also time delays may vary, for example, when the virtual audio source is moving closer to a wall, then the emitted sound is reflected earlier. The apparatus 100 comprises an input controller 140 configured for connecting the audio source signals 104*a* and 104*b*, amplified versions 104*a*" and 104*b*" respectively, with different inputs of the delay lines 108*a-d*, wherein the different inputs are related to a different time delay between the respective input and the output. Simplified, the input controller 140 is configured for receiving parameters related to a necessitated or aimed time delay and for adapting the time delay by which the audio source signal is delayed by the delay line 108*a-d*.

The output signals 102*a-d* may be stored, for example, on or in a data memory, for example a hard drive, a digital video disc (DVD), the internet or other media. Alternatively, the input signals 102*a-d* may be provided to a equalizing network 141 comprising equalization filters 142*a-d* configured for spectrally shaping the output signals 102*a-d*. A spectral shaping of the equalization filters 142*a-d* may be implemented according to sound propagation characteristics and/or a direction of a sound propagation of the emitted sound in the virtual reproduction room. For example, when walls of the virtual reproduction room 130 are adapted to attenuate high frequencies, the equalization filters 142*a-d* may be implemented according to such a characteristic and may allow for sound adjustment according to a sound direction.

Output signals 144*a-d* of the equalization filters 142*a-d* may thus be configured for reproducing the virtual reproduction scene comprising the virtual audio objects, the virtual reproduction room 130 and the virtual loudspeakers 132*a-d* as when the virtual reproduction room 130 and the virtual loudspeakers 132*a-d* were real. The obtained signals 144*a-d* may be stored on a storage medium and/or provided to a panner 150 of the audio system 1000, wherein the panner 150 is configured for providing (real) loudspeaker signals 152*a-f* in a number according to a number of real loudspeakers 162 in a real reproduction room 160. Simplified, the panner 150 is configured for panning a number of loudspeaker signals 144*a-d* having a number according to a number of the virtual loudspeakers 132*a-d* to a number of loudspeaker signals 152*a-f* having a number according to a number of real loudspeakers 162*a-f*. In general, a number of real loudspeakers 152*a-f* may be higher or lower than a number of virtual loudspeakers 132*a-d*. A number of real loudspeakers may depend on a user setup and may be even unknown, when generating the output signals 102*a-d* and/or the loudspeaker signals 144*a-d*. Thus, the generation of the output signals 102*a-d* and/or of the loudspeaker signals 144*a-d* may be regarded as being independent from the reproduction room. A number of output signals 102*a-d*, delay paths 106*a-d* and equalization filters 142*a-d* for filtering the output signals may thus be equal. Simplified, the delay lines 106*a-d* are associated to a direction of sound propagation of the early reflections in the virtual reproduction room 130. Filter parameters of the equalization filters 142*a-d* may be adapted based on the direction of sound propagation.

Reproducing an audio scene may comprise reproducing of direct sound, i.e., an unreflected signal from the reproduced audio object to the listener. The audio reproduction system 1000 may comprise equalization filters 143*a* and 143*b* configured for equalizing, i.e., spectrally shaping, the audio source signal 104*a* and/or 104*b*, to obtain spectrally shaped audio source signals 145*a* and 145*b*. The panner 150 may be configured for receiving the audio source signals 104*a* and 104*b* and/or the spectrally shaped signals 145*a* and 145*b*. The panner 150 may further be configured for providing the loudspeaker signals 152*a-f* based on the loudspeaker signals 144*a-d* and on the audio source signals 104*a* and 104*b* the spectrally shaped versions thereof, respectively. Simplified, the panner 150 may provide the loudspeaker signals 152*a-d* comprising an information related to the direct sound, to the early reflections and to the late reverberations.

Although the equalization filters 152*a-d* were described as being configured for receiving the output signal 102*a-d*, the equalization filters 142*a-d* may also be configured for receiving an intermediate delay line signal, which is, for example, not attenuated by the attenuation filters 112*a-d*. Such a scenario is described later and allows for obtaining loudspeaker signals 144*a-d* and therefore loudspeaker signals 152*a-d* comprising reverberated signals in an absence of reflected portions.

The apparatus 100 may comprise an output controller 170 configured for connecting an equalization filter 142*a-d* to an output tap of a delay line 108*a-d*. At the output tap the intermediate delay line signal may be obtained. Based on changed sound reflection characteristics of the virtual reproduction room, the output controller 170 is further configured for disconnecting the equalization filter 142*a-d* from the output tap of the delay line 108*a-d* and/or for connecting the equalization filter 142*a-d* to another output tap. According to an embodiment, at most one output tap is connected to the equalization filter 142*a-d*. Both, the input controller 140 and the output controller 170 may be configured to connect only one input tap of a delay line, only one output tap respectively.

Figure 2:
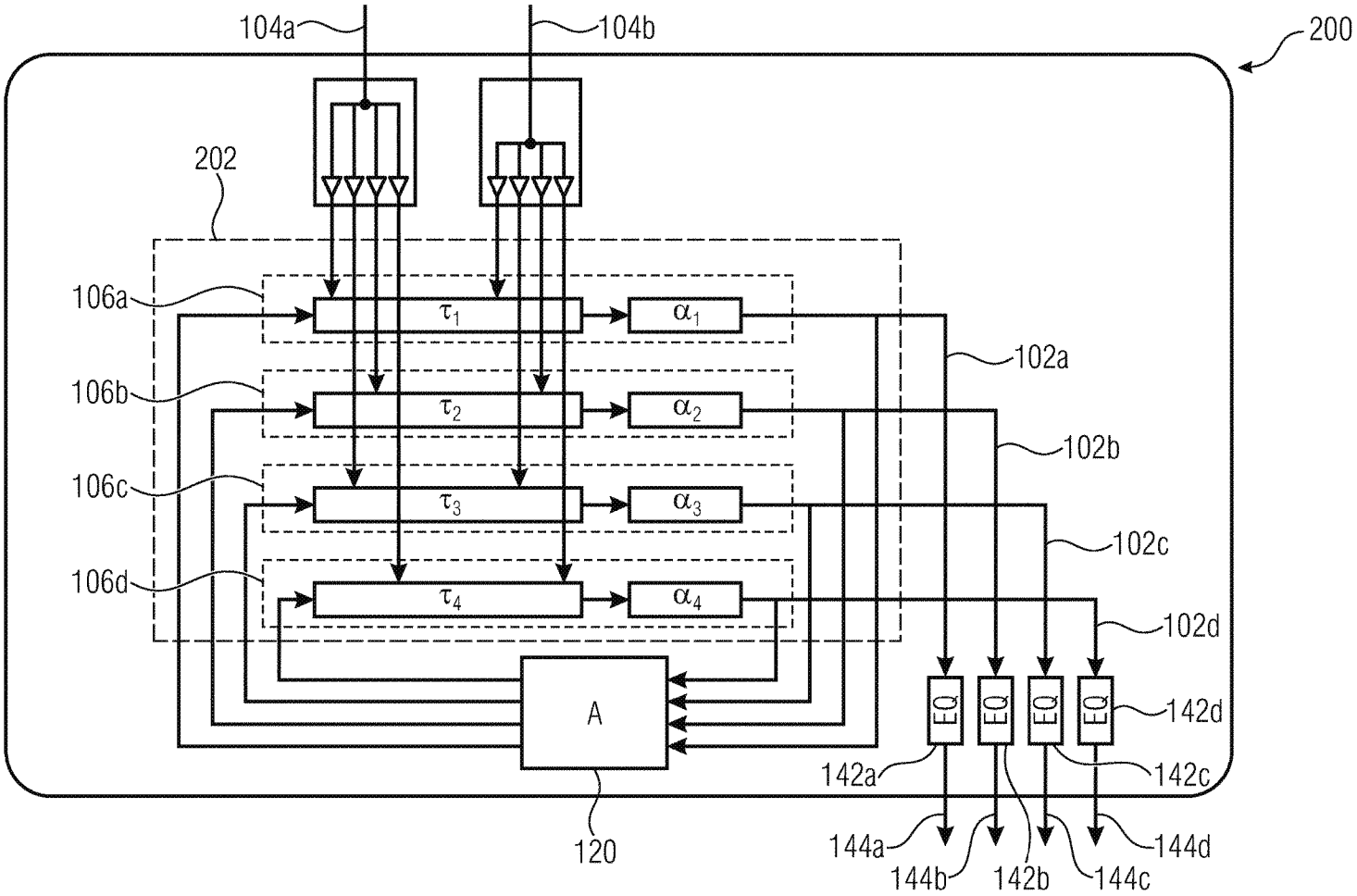
FIG. 2 shows a schematic block diagram of an apparatus for generating the loudspeaker signals according to an embodiment.

FIG. 2 shows a schematic block diagram of an apparatus 200 for generating the loudspeaker signals 144*a-d* according to an embodiment. When compared to the apparatus 100, the apparatus 200 comprises the equalization filters 142*a-d* such that the output signals 102*a-d* may be spectrally shaped internally, i.e., the apparatus 200 is configured for outputting the loudspeaker signals 144*a-d* as output signals.

The apparatus 200 comprises a delay network 202 comprising the delay paths 106*a-d*. The delay network 202 and the feedback processor 120 form a FDN, wherein the feedback processor 120 is configured for performing a feedback and/or a cross-feeding of the output signals 102 to the delay network 202.

In other words, in FIGS. 1 and 2 a novel delay networks multichannel reverberator is proposed, which allows the positioning of a high number of sound sources with a high number of loudspeakers, while maintaining computational efficiency. The FDN is extended to create a high number of spatially assignable decorrelated channels, as well as individual early reflections for all sources and gain control over spatial reverberation time and spectral power.

Figure 10:
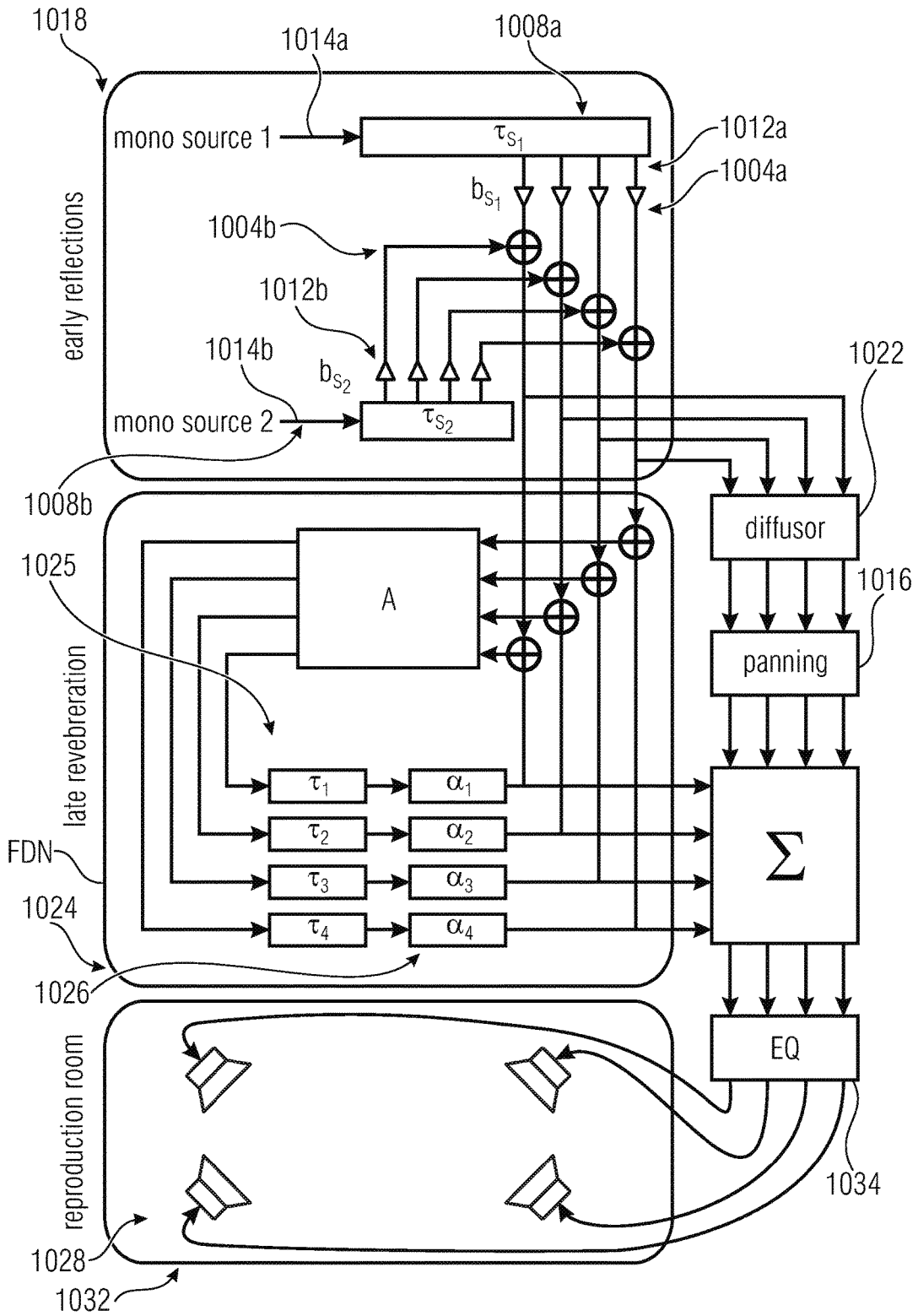
FIG. 10 a concept for obtaining reverberated signals according to conventional technology.

The number of delay lines and the number of sources are scalable from one to higher integers. In prior designs such as the one depicted in FIG. 10, the early reflections and the late reverberation are obtained in different networks that may have to be scaled according to a number of input channels (sources). Further, the FDN carries no explicit direction information, sometimes it even minimizes it by high density techniques like orthogonal mixing. In the feedback delay network depicted in FIGS. 1 and 2, the delay line outputs, i.e., the output signals 102*a-d*, are given directional information by feeding directly into a virtual speaker or by adapting the delay paths 106*a-d* according to the virtual speakers 132*a-d*. These virtual speakers are then rendered into a reproduction room, such as the reproduction room 130, by a panning algorithm of the panner 150. According to the actual rendering situation, the reverberation output may be guaranteed to reproduce the correct spatial characteristics with maximum flexibility.

A direct assignment of the delay lines to virtual directions of the virtual loudspeakers 132*a-d* may provide an advantageous solution when compared to known concepts. Vice versa, an angular direction is assigned to each filtered delay line output, the output signals 102*a-d*, and therefore to the delay line 108*a-d* itself. This one-to-one correspondence between a delay line 108*a-d* and a virtual speaker 130*a-d*, e.g., the delay line 108*a* to the virtual speaker 130*a*, may be regarded as important or even most important when compared to prior designs, a spatial design can be introduced into the FDN framework. Similarly, the attenuation filters 112*a-d* and the output equalization filters 142*a-d* may correspond to spatial directions.

The channel directions as indicated by the virtual loudspeakers 132*a-d* in the virtual reproduction room 130 are then panned to the desired output loudspeaker setup in the actual reproduction room 160. Every virtual speaker 132 may be understood as a point source on a sphere around the listener, which can be reproduced by the physical speakers with weighted gains depending on their relative position. For example, a Vector-Based Amplitude Panning (VBAP) as described in [6] may be employed as a simple and effective choice. Alternatively, especially in a scenario utilizing a high number of loudspeakers such as at least 20, at least 30 or at least 50, a panning may be performed as a so-called hard panning, i.e., the loudspeaker signal 144*a-d* is provided to the closest real loudspeaker 162*a-f*, i.e., having the closest distance to a virtual loudspeaker 132*a-d* that would emit the sound signal.

The intermediate step of a virtual reproduction room allows for a high or even maximal flexibility in the choice of loudspeaker setups and maintains the spatial and acoustic features of the reverberation with a good level or maybe even as best as possible. The resulting mixing matrix, i.e., the feedback processor 120, is very sparse in terms of computational complexity for multichannel loudspeaker setups.

The delay lines 108*a-d* are positioned to discretize the panning sphere around the listening position. The particular positioning may be panned on the sound design, e.g., they can be placed equally spaced on the sphere or certain sections of the sphere may be enhanced by the number of delay lines.

Figure 9:
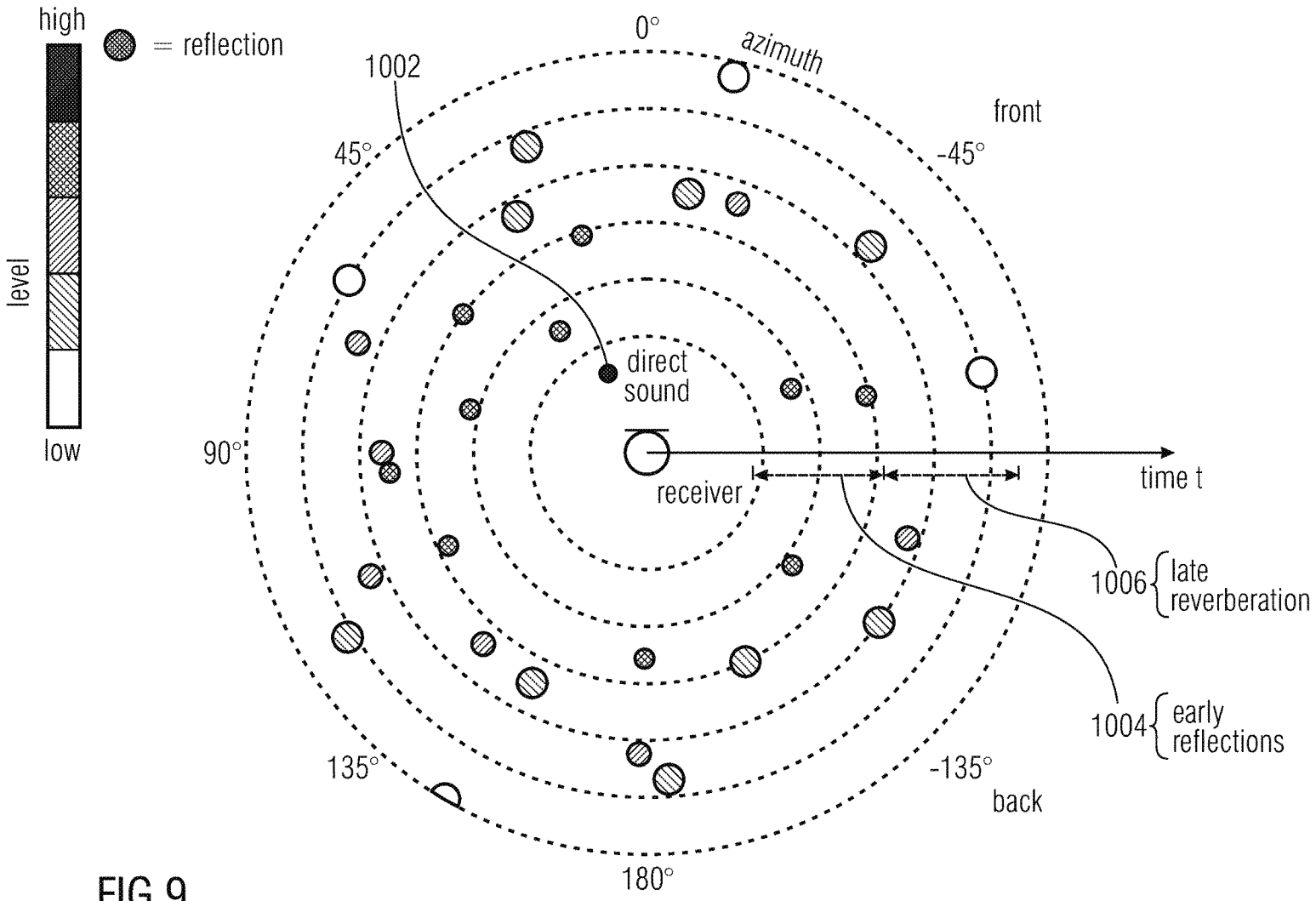
FIG. 9 shows a schematic spatial representation of reverberation in only two dimensions.

Depending on the target loudspeaker setup, certain sections of the sphere can be omitted and others can be condensed, e.g., for: loudspeaker setups like 5.1+4 or 22.2 large parts of the lower hemisphere can be omitted, or depending on the application it may be favorable to place more delay lines in the front, the natural stage direction. Such an area is denoted as "front" in FIG. 9. It may be noted that the angular resolution of the virtual speakers can be higher than the arrangement of the physical speakers.

Figure 3:
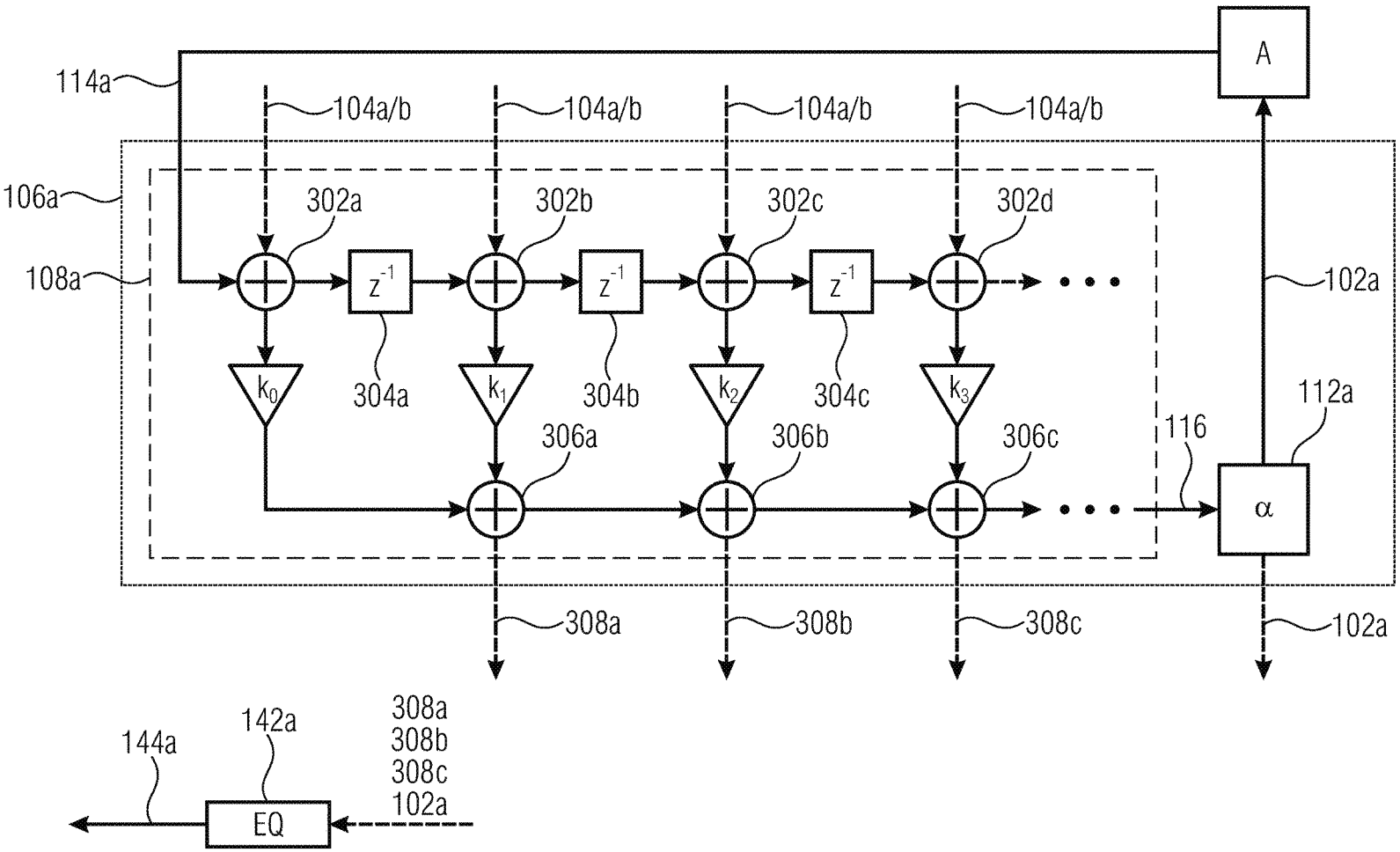
FIG. 3 shows a schematic block diagram of the delay path according to an embodiment.

FIG. 3 shows a schematic block diagram of the delay path 106*a*, wherein the following description is also applicable for the other delay paths 106*b-d*. The delay path 106*a* comprises the delay line 108*a* which is, for example, implemented as a finite impulse response filter. The delay line 108*a* comprises a multitude of input taps 302*a-d*. For example, the delay line 108*a* may comprise at least 4, at least 16, at least 500 or even at least 1000 input taps 302*a-d*. The input taps 302*a-d* are configured for receiving audio source signals, such as the audio source signals 104*a* and 104*b*, a version and/or an amplified version thereof. For example, the input controller 140 depicted in FIG. 1 may connect or disconnect a first audio source signal to or from one of the input taps 302*a-d* while not connecting this input signal to other input taps, such that the audio source signal is connected to the delay line 108*a* at one input tap. This allows for a time variant delay time of the delay line. The input controller 140 may be configured to connect the same or a different input tap 302*a-d* to a further audio source signal and/or the input signal or an (amplified) version thereof to a different delay line The input taps 302*a-d* are arranged sequentially and with a delay block 304*a-d* between two input taps 302*a-d*. Thus, a signal received at the input tap 302*a* is forwarded to the delay block 304*a,* delayed and then forwarded to the second input tap 302*b*. When the first input tap 302*a* receives the reverberated audio signal 114*a* and when the second input tap 302*b* receives the audio source signal 104*a,* the reverberated audio signal 114*a* is combined with the audio source signal 104*a* at the second input tap. A last output tap, e.g., the outtap 306*c* may be the output of the filter providing the combined signal 116, such that a "last" intermediate delay line signal, e.g., 308*c,* may be the combine signal.

Alternatively or in addition, for example, when the third input tap 302*c* receives the audio source signal 104*b,* at the third input tap 302*c* the reverberated audio signal 114*a,* the audio source signal 104*a* and the audio source signal 104*b* are combined. Each of the signals 114*a,* 104*a* and 104*b* is delayed by a different time delay, i.e., by a different number of delay blocks 304a-c. A signal combined at an input tap 302*a-d* may be amplified or attenuated by a gain factor or an attenuation factor $k_1$-$k_3$. Subsequent amplified or attenuated signals are combined at output taps 306*a-c*, wherein at the output taps 306*a-c* intermediate delay line signals 308*a-c* may be obtained. For example, the output controller 170 may connect or disconnect one of the output taps 306*a-c* or an output of the attenuation filter 112*a* with or from the equalization filter 142*a* such that the equalization filter 142*a* may receive one of the intermediate delay line signals 308*a-c* or the output signal 102*a*.

Figure 4A:
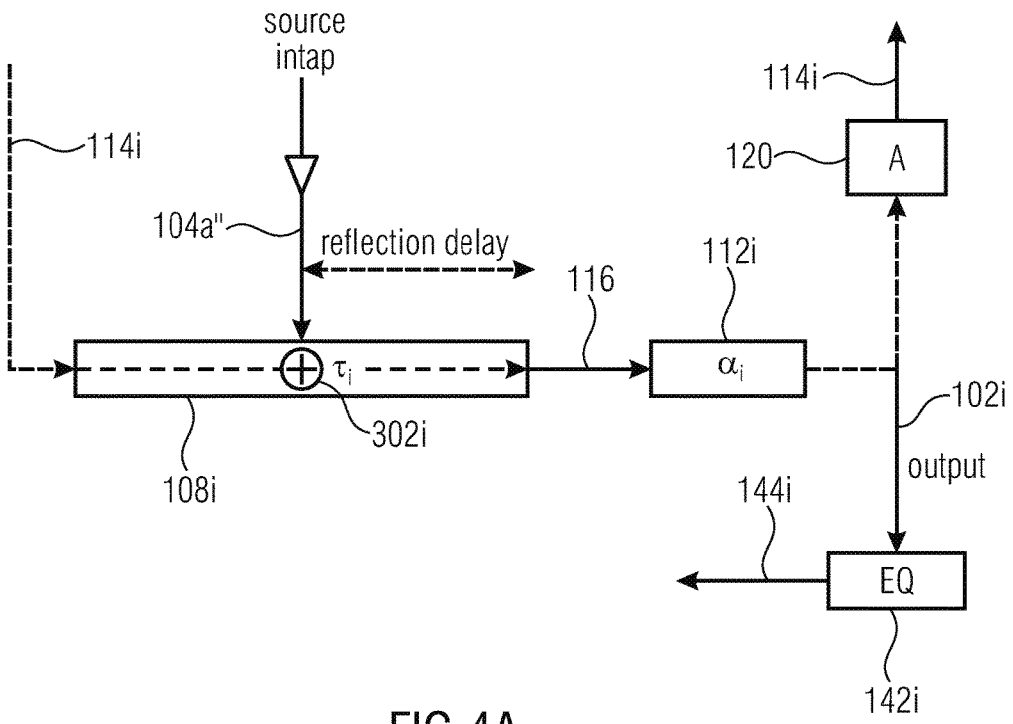
FIG. 4*a* shows a schematic block diagram of a scenario in which the loudspeaker signal comprises a reflected portion and a reverberated portion of the audio source signal according to an embodiment.
Figure 4B:
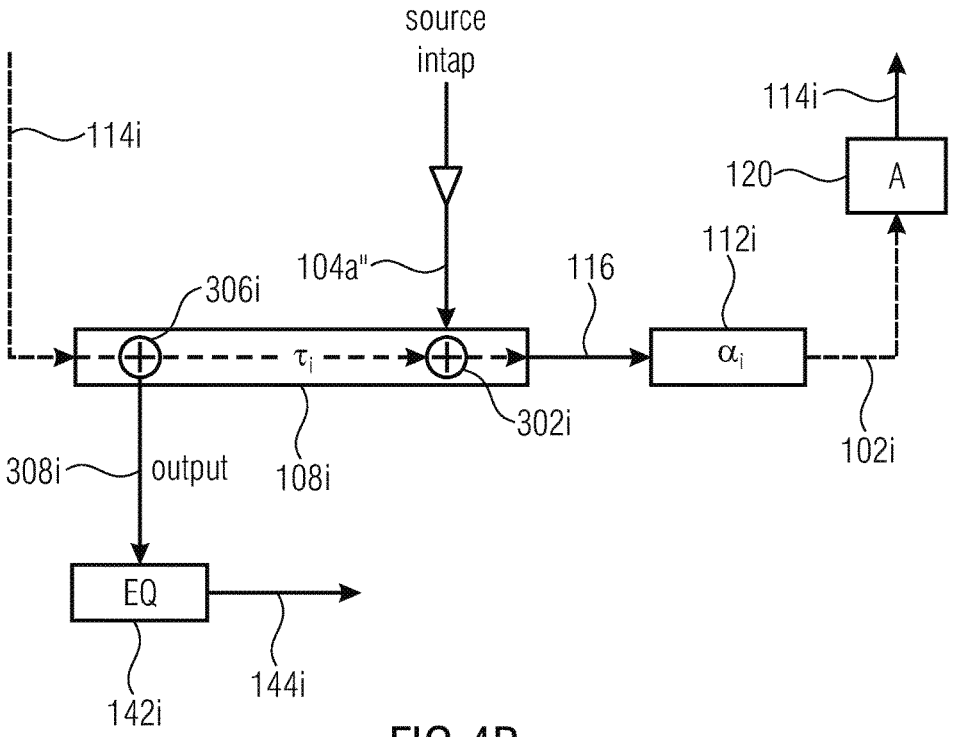
FIG. 4*b* shows a schematic block diagram of a different scenario in which the equalization filter s connected to an output tap of the delay line according to an embodiment.

FIGS. 4*a* and 4*b* depict a schematic block diagram of different scenarios for obtaining the loudspeaker signals 144.

FIG. 4*a* shows a schematic block diagram of a scenario in which the loudspeaker signal 144 comprises a reflected portion and a reverberated portion of the audio source signal 104*a*. A delay line 108*i* which may be, for example, one of the delay lines 108*a-d* is configured for receiving a reverberated audio signal 114*i,* e.g., one of the reverberated audio signals 114*a-d*, at a first input. At an input tap 302*i,* which may be any input tap such as one of the input taps 302*a-d*, the delay line 108*i* is configured for receiving an amplified version 104*a*" of the audio source signal 104*a*. Thus, the reverberated audio signal 114*i* and the audio source signal 302*i* are combined at the input tap 302*i*.

A delay time from the input tap 302*i* to the filter output, i.e., until the attenuation filter 112*i* receives the combined signal 116 may be regarded as a reflection delay. An output signal 102*i* of the attenuation filter 112*i,* for example one of the output signals 102*a-d*, is forwarded to the equalization filter 142*i* such that the loudspeaker signal 144*i* comprises a reverberated portion and a reflected portion. When the filters of the delay line 108*i* and/or of the attenuation filter 112*i* are, for example, in an initial or basic state, then the reverberated signal 114*i* may be also static and/or initial, for example in a zero-state. When the audio source signal 104 is applied to the system and the delay line 108*i* receives the amplified version thereof, then the loudspeaker signal 144*i* may first only comprise the reflected portion as the reverberated signal 114*i* is different from the zero-state in the next iteration. Simplified, the audio source signal first travels once through parts of the delay line 108*i* such that the loudspeaker signal 144*i* is based on the delayed (reflected) audio source signal. Then, the output signal 102*i* is reverberated and combined with the audio source signal such that in a following time interval the loudspeaker signal 144*i* is based on reflected and reverberated portions.

FIG. 4*b* shows a schematic block diagram of a different scenario in which the equalization filter 142*i* is connected to an output tap 306*i,* for example, one of the output taps 306*a-c*. The output tap 306*i* is, when regarded schematically in the time domain, arranged "before" the input tap 302*i* connected to the audio source signal. Thus, when regarded from the zero-state, the audio source signal is first delayed, then attenuated by the attenuation filter 112*i*, reverberated by the feedback processor 120 and input into the delay line 108*i*. An intermediate delay line signal 308*i* is connected to the equalization filter 142*i*. Based on this scenario, the loudspeaker signal 144*i* may comprise reverberated portions when being different from the zero-state. By this, signals with low or even no early reflections may be obtained. Such a scenario may be desired, for example, when an acoustic scene is reproduced where no distinct early reflections shall occur, for example, in a diffuse scenarios.

In other words, for every source, intaps, i.e., input taps, up to a number of delay lines can be chosen in a way that the first reflections are determined in gain, delay and approximated direction and all reflections are filtered by the attenuation filter. The proposed apparatus and method comes with reduced computational cost compared to known prior methods. In the case that spatial early reflections are not desired, an alternative approach as depicted in FIG. 4*b* may be realized to the delay line design. The difference between FIG. 4*a* and FIG. 4*b* is solely that the position of the outtap, i.e., the output tap 308*i,* is connected to the equalization filter. Instead of the feedback matrix input, i.e., the output signal 102*i,* the output, i.e., the intermediate delay line signal 308*i,* is taken from the beginning (a section in front of the connected input) of the delay line 108*i,* in a way that the source intap is placed after the outtap. Consequently, the output signal was processed by the feedback processor (feedback matrix) at least once and possibly distributed to all delay line directions. This results in a less prominent early reflection and faster increase in reflection density.

Figure 5A:
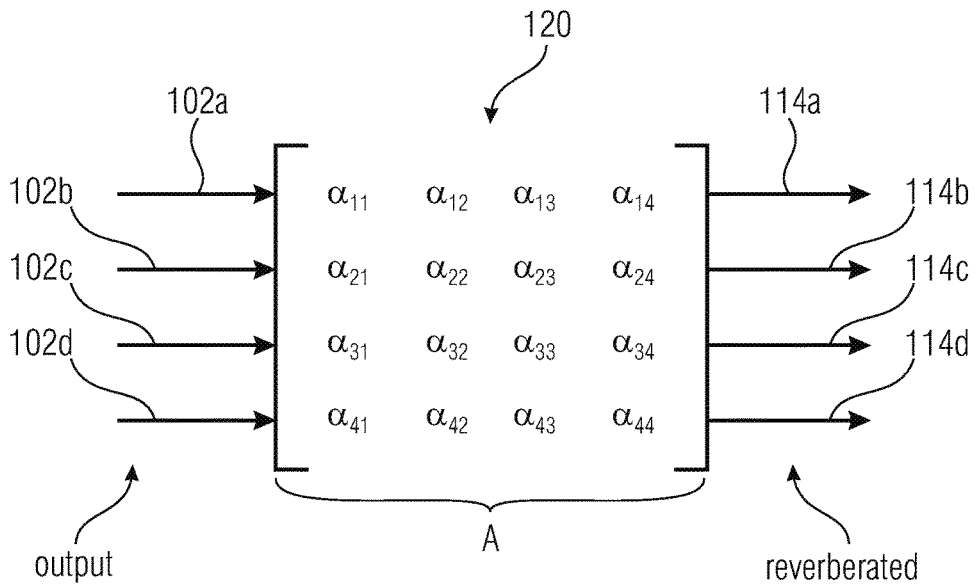
FIG. 5*a* shows a schematic block diagram of the feedback processor configured for reverberating the output signals according to an embodiment.

FIG. 5a shows a schematic block diagram of the feedback processor 120 configured for reverberating the output signals 102*a-d*. As it may be depicted by matrix operations, the feedback processor is configured for combining the output signals 102*a-d* with different reverberation parameters $a_{11}$-$a_{44}$. Parameters $a_{11}$, $a_{22}$, $a_{33}$ and $a_{44}$ on the diagonal of the matrix A refer to a variation (amplification or attenuation) of the output signal 102*a-d*. Other values refer to influences (reverberation) of other output signals 102*a-d* to a respective output signal. The reverberated audio signals 114*a-d* may thus be based and/or influenced by one or more output signals 102*a*. Values of the parameters $a_{11}$-$a_{44}$ may refer to a configuration of the virtual reproduction room, for example, a loudspeaker setup and/or reflection characteristics of the virtual reproduction room influencing reverberation. Simplified, the matrix operation may be noted, for example as:

$$\underline{r}=\underline{A}*\underline{o} \text{ or, alternatively } \underline{r}^T=\underline{o}^T*\underline{A}^T$$

wherein $\underline{r}$ denotes a vector comprising the reverberated signals 114*a-d*, $\underline{A}$ denotes the reverberation matrix, $\underline{o}$ denotes the output signals 102*a-d* and $x^{\underline{T}}$ denotes a transposed version of x.

Figure 5B:
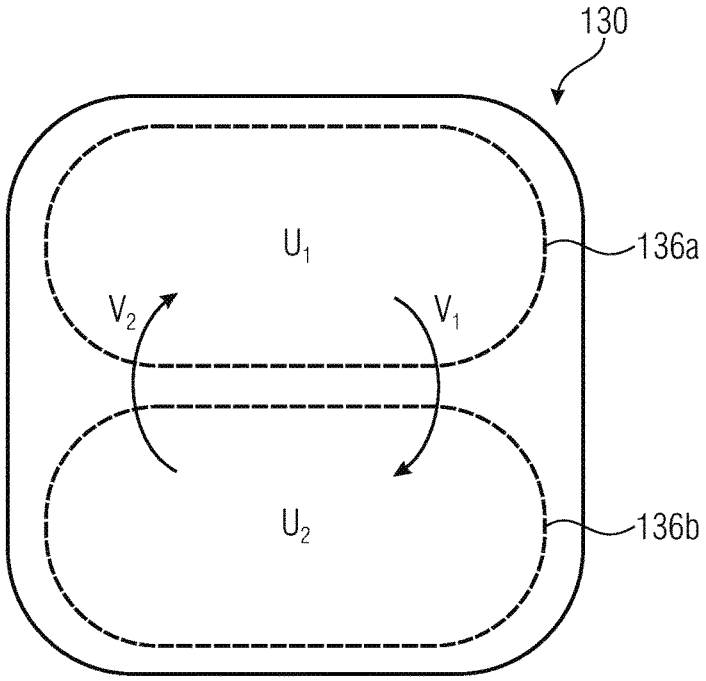
FIG. 5*b* shows a schematic diagram of the virtual reproduction room comprising, for example, two sub-rooms according to an embodiment.

FIG. 5*b* shows a schematic diagram of the virtual reproduction room 130 comprising, for example, two sub-rooms 136*a* and 136*b*. The sub-room 136*a* may be, for example, a front or a first side of a room. The virtual reproduction room 130 comprises propagation characteristics, e.g., defined by virtual objects in the room and/or a material of the objects or the walls as well as by the structures themselves.

The sub-room 136*b* may be, for example, a back or a second, different side of the virtual reproduction room 130 when compared to the sub-room 136*a*. The sub-room 136*a* may be parameterized by a parameter block $U_1$ (comprising a subset of the parameters $a_{11}$-$a_{44}$). The sub-room 136*b* may be parameterized by a parameter block $U_2$ (comprising an at least partially different subset of the parameters $a_{11}$-$a_{44}$). Parameter blocks $V_1$ and $V_2$ denote an acoustic coupling from the first sub-room 136*a* to the second sub-room 136*b*, from the second sub-room 136*b* to the first sub-room 136*a* respectively. The matrix A may be structured according to the parameter blocks $U_1$, $U_2$, $V_1$ and $V_2$. The sub-rooms 136*a* and 136*b* may also be two different rooms comprising an acoustic coupling between each other, for example, two rooms connected by a door. This allows for an easy parameterization of the virtual reproduction room 130. The parameterization may be obtained based on the maintained directional information of the reflections and/or of the reverberations.

In other words, the feedback matrix A is often chosen to control the reflection density. Every entry in the matrix indicates the gain from one delay line to another. The more dense the matrix is, the more dense the reverberation tail will be. The proposed apparatus and method allow for subdividing the matrix A into directional sections to control the directional propagation of the reflections over time. The virtual direction of the delay lines are known, so that a matrix entry indicates the propagation from one direction to another, e.g., a diagonal entry keeps the direction. For homogeneous rooms, where every direction is mixed with each other, uniform matrix gains may be appropriate. Two acoustically coupled rooms, e.g., a room and a neighboring hallway can be implemented by a 2×2 block matrix.

The diagonal blocks $U_1$ and $U_2$ control the mixing of, for example, the front and the back room, respectively. The non-diagonal blocks $V_1$ and $V_2$ may control the leakage between the coupled rooms.

Figure 6A:
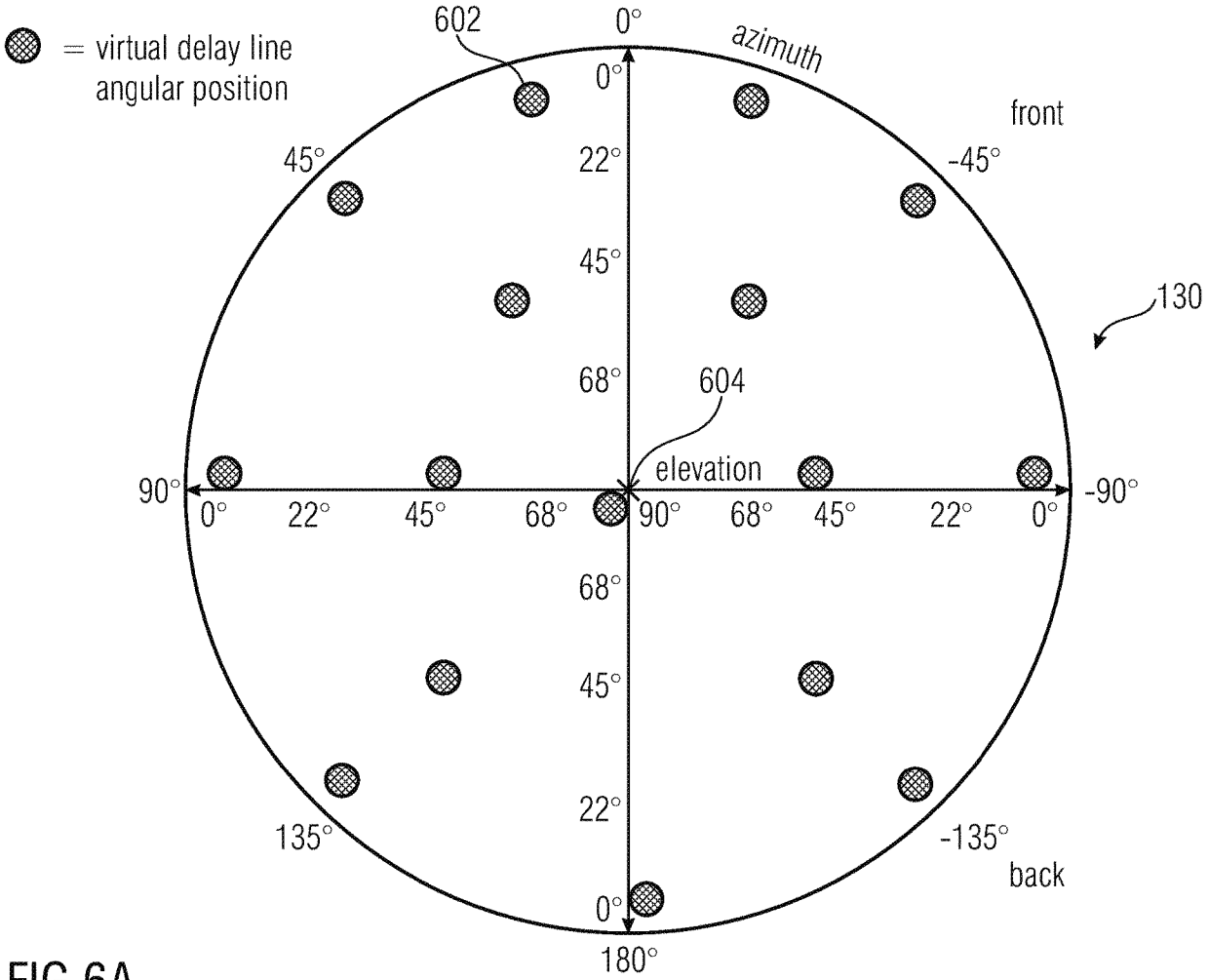
FIG. 6*a* shows a schematic top view of a distribution of 16 delay lines in an upper hemisphere of a virtual reproduction room according to an embodiment.

FIG. 6*a* shows a schematic top view of a distribution of 16 delay lines in an upper hemisphere of a virtual reproduction room 130. Each dot 603 corresponds to a position of a virtual loudspeaker in the virtual reproduction room 130 and may be adapted by the parameters of an associated delay path. Thus, the virtual loudspeaker is at least partially defined by a virtual delay line angular position, i.e., by a position based on parameters of the delay line of the delay path. The virtual loudspeakers are distributed unequally, i.e., asymmetrically. Ten of sixteen virtual loudspeakers are arranged in a front section with respect to a listener's position 604 and with respect to a front direction indicated as zero degrees. Six of sixteen virtual loudspeakers are arranged in a back region of the virtual reproduction room. According to the number of sixteen virtual loudspeakers, the apparatus 100 or 200 comprises 16 delay paths. In other words, FIG. 6*a* shows a distribution of 16 delay lines in the upper hemisphere.

Figure 6B:
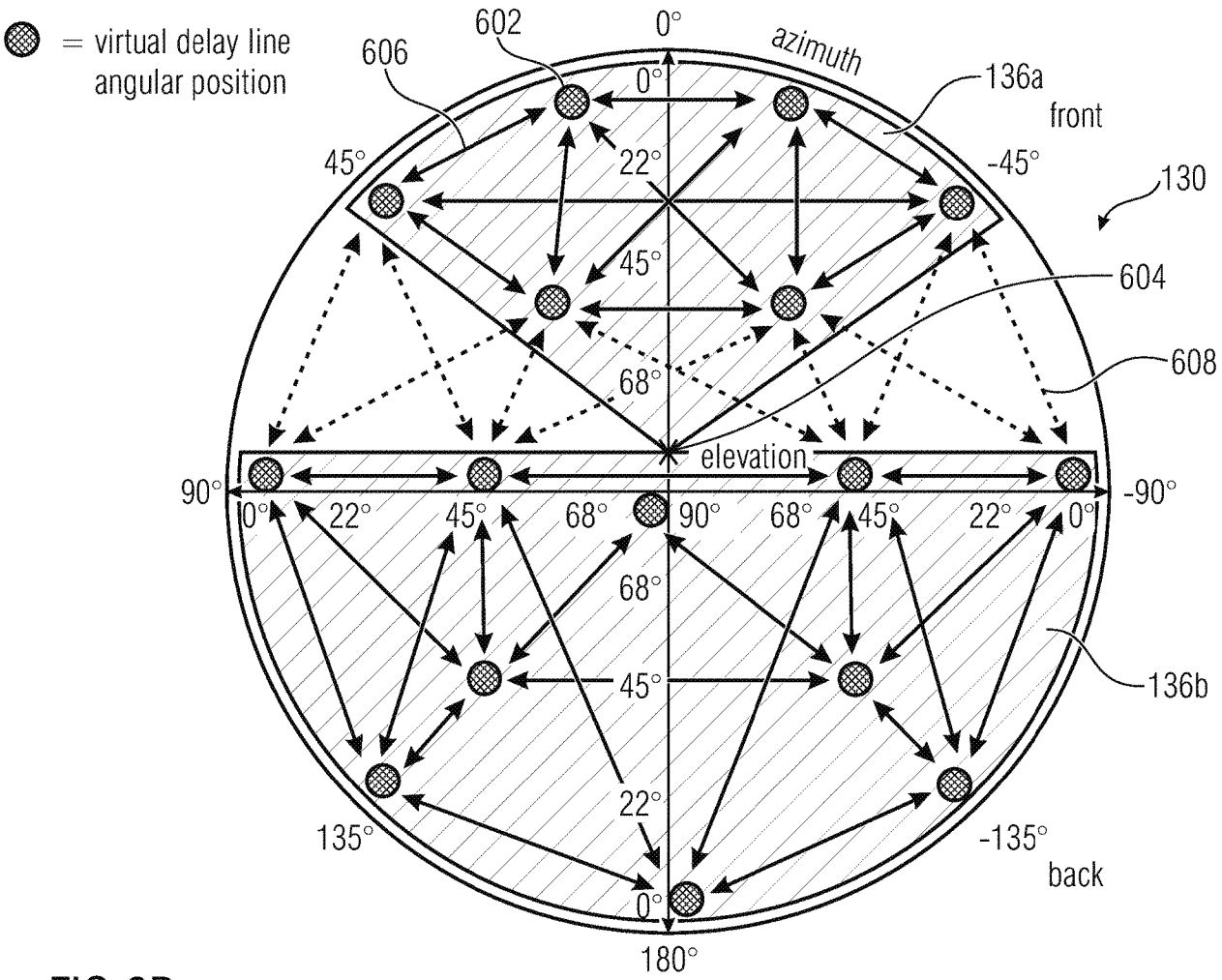
FIG. 6*b* shows a schematic implementation of an acoustic coupling between the virtual loudspeakers realized by the parameters of the matrix A according to an embodiment.

FIG. 6*b* shows a schematic implementation of an acoustic coupling between the virtual loudspeakers realized by the parameters of the matrix A. Each of the arrows 606 depicts a coupling between two loudspeakers, i.e., a parameter $a_i$ that is unequal to zero. In contrast, dotted arrows 608 indicate, that along the respective path there is no acoustic coupling which may be implemented by a parameter $a_i$ equal to zero. A gray shaded surface arranged in the front region corresponds, for example, to the first sub-room 136*a* of the virtual reproduction room 130. A gray shaded surface arranged in the back of the virtual sub-room 130 may correspond, for example, to the sub-room 136*b*. As the delay line is related to a direction and to a position of a virtual loudspeaker in the virtual reproduction room it may be also related to a distance between the virtual loudspeaker and a sound reflecting structure of the virtual reproduction room 130. $a_i$ may also be denoted as reverberation parameters as they are related to the reverberation of the sound signals based on the acoustic coupling of the virtual reproduction room. The parameters $a_i$ may be adjusted according to a reverberation characteristic of the virtual reproduction room 130. Thus, the reverberation time and therefore the corresponding filter coefficients may be adapted according and/or dependent on a direction of (sound) arrival.

Accordingly, the attenuation filters and/or the equalization filters related to virtual loudspeakers arranged in different sub-rooms may be adjusted differently, i.e., it may be that they implement different reverberation characteristics.

In other words, FIG. 6*b* shows a schematic scheme for direction dependent mixing for a front and back coupling and includes a selection of a gain path depicted as arrows between the delay line directions into the delay line distribution of FIG. 6*a*. Reverberation times in simple room geometries can be described by a single curve. More extreme cases of coupled rooms, or inhomogeneous rooms like cathedrals with high dome-shaped ceilings can have directional dependent reverberation time. The proposed method and apparatus allow for a direction dependent adjustment of the reverberation time. This is based on the direction dependent mixing matrices A. If the blocks are nearly isolated, and mixing is slowly propagating, the spectral filtering of the attenuation filters 112*a-d* stays intact for each direction. Following the example above of a coupled room, which is depicted in FIGS. 5*b* and 6*b*, by choosing a different attenuation strength for the attenuation filter in the room and the hallway, i.e., the sub-rooms 136*a* and 136*b*, different reverberation times can be achieved in the front and the back. Another example is a long reverberation time in the dome ceiling of a cathedral. Within a concert hall, a short reverberation time at the direction of the orchestra, and an enveloping longer reverberation time from the sides of the back can create a musically balanced setting.

Figure 7:
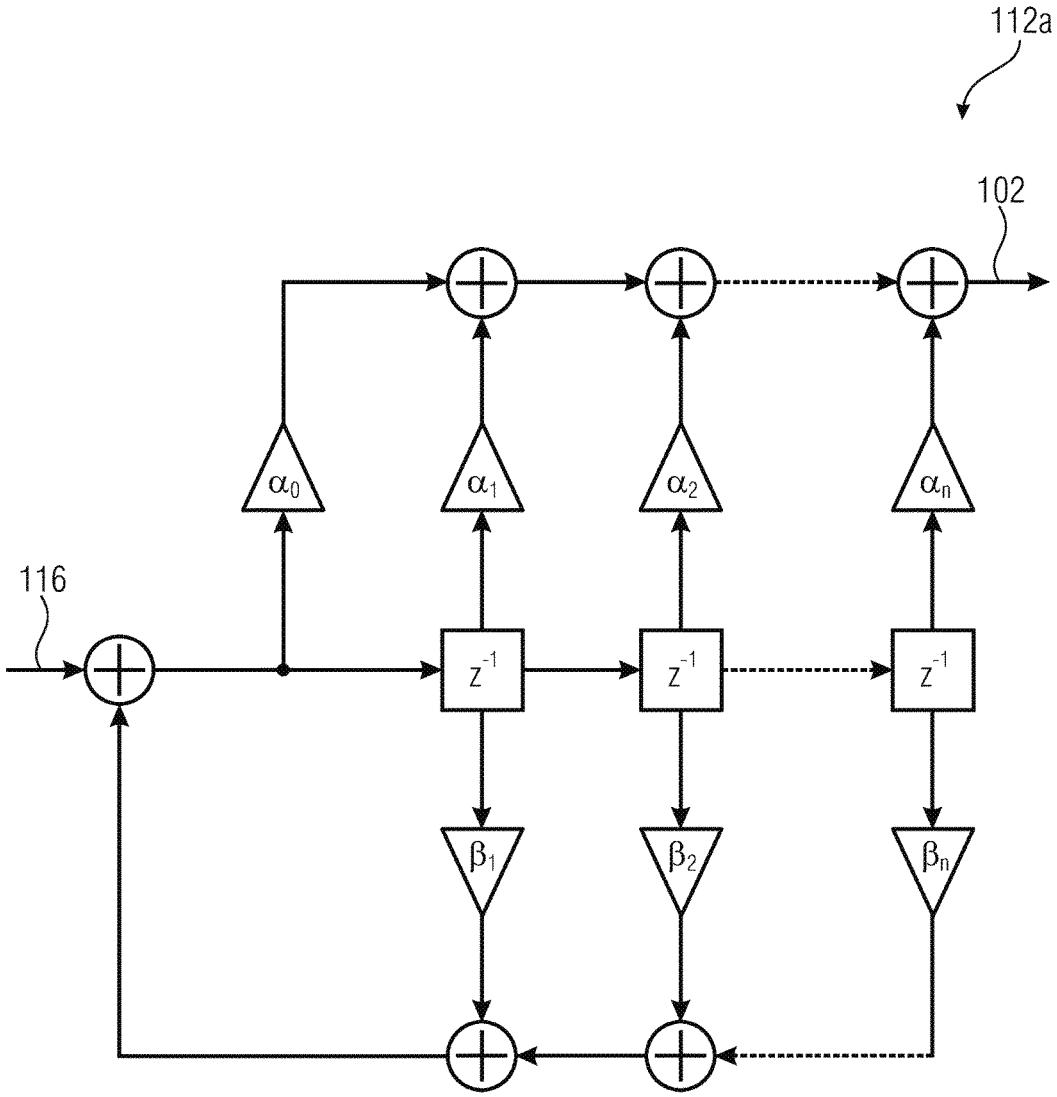
FIG. 7 shows a schematic block diagram of a possible realization of the attenuation filter according to an embodiment.
Figure 8:
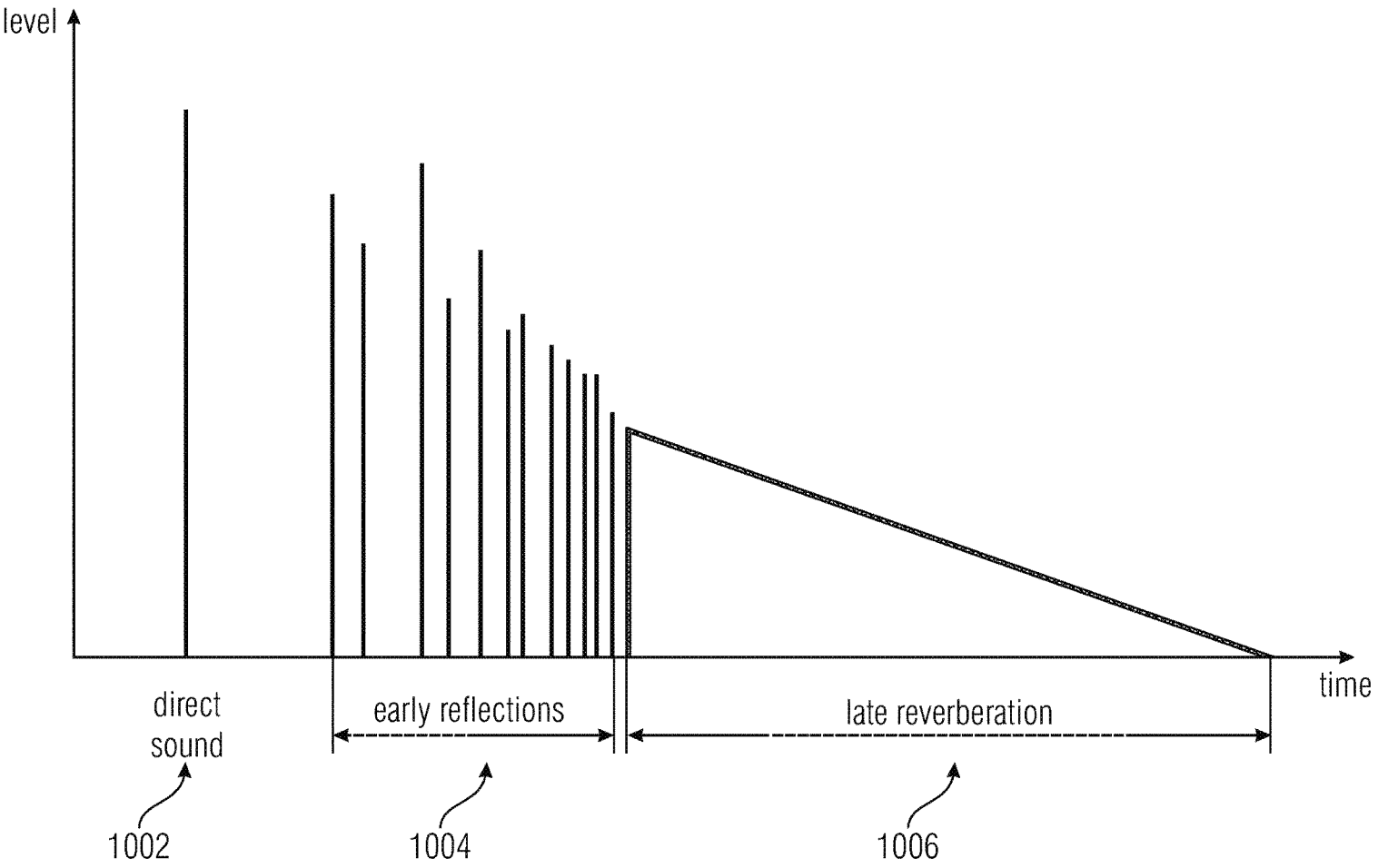
FIG. 8 shows a schematic single channel representation of reverberation which is an impulse response of a typical room with direct sound, early reflections and late reverberation.

FIG. 7 shows a schematic block diagram of a possible realization of the attenuation filter 112*a*, wherein the following description also applies to the attenuation filters 112*b-d*. The attenuation filter 112*a* is configured for controlling the reverberation time and diffuseness of the feedback delay network. The coloration and diffusion of the early reflections may carry important perceptual cues of the room geometry and boundary materials. The attenuation filter 112*a* being arranged at the output of the delay may ensure that there is no unprocessed copy of the direct signal in the feedback delay network output, which might be obtained, for example, when the audio source signal is connected to the last input tap of the delay line of a delay path. When the attenuation filter 112*a* is arranged for adjusting the reverberation time, the filtering of the early reflections may be achieved without extra costs in terms of extra filters. Although the attenuation filter 112*a* is depicted as being realized as a direct-form 2 infinite impulse response (IIR) structure, the attenuation filter 112*a* may also be realized as another filter type, for example as a direct-form 1 IIR-structure, as a cascaded IIR-filter, a Lattice-filter or the like. Alternatively, also a filter with a finite impulse response structure may be arranged.

In other words, to place a certain reflection in direction and time, the closest delay line to the desired direction of arrival may be chosen and the intap is placed in the delay line with appropriate distance. The direction of the early reflection is approximated by the angular delay line distribution and may reflect the lowered DOA perception for early reflections. Compared to known methods, no matter how many input sources are rendered, no extra memory is needed for external delay lines. Also, the dedicated panning unit for the early reflections can be omitted. In known methods, typically extra processing of the early reflection output needs to be done to avoid unattenuated early reflections. The computational costs for the extra intaps are practically equal to the cost of the early reflection outtaps.

Typically, the overall spectral power of a reverberation made to be adjusted, for example by a spectral shaping as it is described for the equalization filters 142*a-d* in FIGS. 1 and 2. This may be performed at the FDN output in the apparatus or as an external apparatus. Hence, the spectral power adjustment may be performed channel-based. However, oftentimes rooms have different boundary materials and therefore varying spectral power curves, e.g., the back reflections have less travel because of a soft back wall than the front reflections which bounce from a stiff material. Above described embodiments allow for a direction dependent adjustment of the spectral power. As the panning directions of the delay lines 108*a-d* in the virtual reproduction room 130 are known, the equalization filters 142*a-d* may be designed according to the direction. Using this concept, the spatial spectral power may be independent from the final loudspeaker setup and is consistent over all choices. The proposed concept integrates the earlier reflections into the existing FDN framework. For every input source, i.e., audio source signal, there is an intap at every delay line as it is described in FIG. 3 with respect to FIG. 1. The "distance" between the intap and the outtap may give the reflection delay. The gain of the reflection is determined by the intap gain applied by the amplifiers 122.

The proposed concept presents techniques for spatial multichannel parametric reverberation. It is based on the Feedback Delay Network as the most general representative of the delay network reverberators.

The proposed concept introduces a spatial interpretation of the delay lines. The intermediate level of a virtual listening room gives weighted flexibility with target loudspeaker setups via a panning algorithm. Therefore, an integrated technique for early reflections is applicable. At the same time, the computational costs can be maintained and direction-of-arrival can be controlled. Further, the proposed method allows for efficient adjustment of the direction dependent spectral power, mixing and reverberation time. The proposed concept allows the creation of spatial reverberation for playback in 3D multichannel speaker setups. Thus, the proposed concept provides techniques for spatial multichannel parametric reverberation. A novel delay networks multichannel reverberator is proposed, which allows the positioning of high numbers of sound sources with a high number of loudspeakers, while maintaining computational efficiency. The proposed concept introduces a spatial interpretation of the delay lines and an integrated technique for processing early reflections. Further, the proposed concept allows for an efficient adjustment of the direction dependent spectral power, mixing and reverberation time.

The attenuation filters of the FDN and/or the equalization filters may be implemented as IIR-filters having a low number of filter coefficients such as at most 200, at most 100 or at most 50 and/or a low order of the filter, such as, for example, at most of order 8, order 5 or order 3 or lower. Attenuation factors of the attenuation filters may be adjusted based on a frequency selective reverberation time of the combined signal. Filter coefficients of the equalization filters may be based on a frequency selective spectral energy of the output signal, the intermediate delay line signal respectively. In addition, the filter coefficients of the attenuation filters and/or of the equalization filter may be set according to a direction of arrival of the sound to be implemented.

Although above described embodiments relate to a number of four and sixteen delay lines, other embodiments relate to a different number of delay lines and therefore virtual loudspeakers, for example, at least three, at least eight, twelve or sixteen.

Although the above embodiments refer to a realization of the feedback processor such that the feedback processor is configured for performing matrix-based operations, the feedback processor may alternatively or in addition be configured for performing other types of operation such as a convolution operation related to a matrix (e.g. related to IIR- or FIR-filters), a transformation, a difference, a division and/or non-linear operations.

Although the above embodiments refer to a reproduction room comprising six loudspeakers, a reproduction room may also comprise a different number of loudspeakers, for example, at least two, at least four, ten or more.

Although the above embodiments relate to delay lines being implemented as FIR filters, delay lines may also be realized as different types of filters and/or without attenuation or gain parameters. For example, a multitude of delay blocks may be implemented digitally such that the delay line may be characterized by a simple number of delay blocks for delaying signals.

Although the above embodiments relate to a virtual reproduction room comprising two sub-rooms or one room, the virtual reproduction room may also comprise three or more sub-rooms. Accordingly, the matrix A may also comprise a different number of parameter blocks which may be separated or combined (partially overlapping) with each other and wherein a number of parameter blocks and/or delay paths may be based on a number of coupling paths between the sub-rooms. However, although the matrix A is depicted as being quadratic, based on the coupling parameters, the matrix A may also be non-quadratic and/or comprise one or more sub-room related matrices having a non-quadratic form.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

LITERATURE

[1] S. Diedrichsen, "Methods, modules, and computer-readable recording media for providing a multichannel convolution reverb," U.S. Pat. No. 8,363,843 BB, 2013.

[2] P. S. Anand, "Method and device for artificial reverberation," Patent US2 002 067 836 AA, 2001.

[3] J. M. Jot, "Method and system for artificial spatialisation of digital audio signals," U.S. Pat. No. 5,491,754 A, 1996.

[4] J.-M. Jot, "An analysis/synthesis approach to realtime artificial reverberation," in International Conference on Acoustics, Speech, and Signal Processing, ICASSP-92., vol. 2. IEEE, 1992, pp. 221-224.

[5] L. Dahl and J.-M. Jot, "A reverberator based on absorbent all-pass filters," in Proc. COST G-6 Conference on Digital Audio Effects (DAFX-00), 2000.

[6] V. Pulkki, "Virtual sound source positioning using vector base amplitude panning," Journal of the Audio Engineering Society, vol. 45, no. 6, pp. 456-466, 1997.

The invention claimed is:

1. Apparatus for generating a first multitude of output signals based on at least one audio source signal, the apparatus comprising:

a delay network comprising a second multitude of delay paths each delay path comprising a delay line and an attenuation filter, each delay line being configured for delaying delay line input signals and for combining the at least one audio source signal and a reverberated audio signal to acquire a combined signal, wherein the attenuation filter of a delay path is configured for filtering the combined signal from the delay line of the delay path to acquire an output signal, wherein the first multitude of output signals comprises the output signal; and a feedback processor configured for reverberating the first multitude of output signals to acquire a third multitude of the reverberated audio signals comprising the reverberated audio signal;

wherein the combined signal comprises an audio source signal portion and a reverberated signal portion and wherein the delay line comprises a sixth multitude of input taps being configured for receiving the audio source signal or a weighted version of the audio source signal, wherein the apparatus comprises an input controller configured for connecting the audio source signal or the weighted version of the audio source signal and one of the sixth multitude of input taps and based on a first position of a virtual audio source in a virtual reproduction room and while not connecting the audio source signal or the weighted version of the audio source signal to a different input tap of the sixth multitude of input taps, and wherein the input controller is configured for disconnecting the audio source signal or the weighted version of the audio source signal from the one of the sixth multitude of input taps based on a second position of the virtual audio source, the second position being different from the first position; or wherein the combined signal comprises an audio source signal portion and a reverberated signal portion and wherein the delay line comprises a seventh multitude of output taps being configured for providing the combined signal or an intermediate delay line signal, wherein the apparatus comprises an output controller configured for connecting an equalization filter to the output signal or top one of the seventh multitude of output taps based on a first reflection characteristic of a virtual reproduction room, while not connecting a different output tap of the seventh multitude of output taps to the equalization filter, and wherein the output controller is configured for disconnecting the equalization filter from the output signal or from the intermediate delay line signal based on a second reflection characteristic of the virtual production room being different from the first characteristic.

2. Apparatus according to claim 1 wherein, wherein a number of the first multitude, the second multitude, the third multitude and a fifth multitude of equalization filters is equal.

3. Apparatus according to claim 2, wherein the delay lines are associated to a direction of arrival with respect to a listening position of a reflected sound in a virtual reproduction room, wherein filter parameters of the equalization filter are adapted based on the direction of arrival.

4. Apparatus according to claim 1, further comprising a distributor configured for distributing the audio source signal into a number of versions thereof, the number of versions being at least a number of the second multitude of delay paths, the versions of the audio source signal having, with respect to each other, a delay of at most 20% of a maximum time delay of the second multitude of delay lines.

5. Apparatus according to claim 1, wherein the distributor further comprises an eighth multitude of amplifiers being configured for weighting the versions of the audio source signal to acquire weighted versions of the audio source signal, wherein the weighted versions of the audio source signal are associated to an audio signal of a virtual sound source in a virtual reproduction room comprising virtual loudspeakers and wherein a gain factor of an amplifier of the eighth multitude of amplifiers is associated to a characteristic of the reflection of the audio source in the virtual reproduction room.

6. Apparatus according to claim 1, wherein the attenuation filter comprises a ninth multitude of filter coefficients;

wherein the delay path is associated with a virtual position of a virtual loudspeaker in a virtual reproduction room having virtual sound propagating characteristics and sound reflecting structures;

wherein the filter coefficients are related to a reverberation time of the virtual reproduction room in which the audio source signal is reverberated.

7. Apparatus according to claim 1, wherein the attenuation filter comprises a ninth multitude of filter coefficients;

wherein the delay path is associated with a virtual position of a virtual loudspeaker in a virtual reproduction room having virtual sound propagating characteristics and sound reflecting structures;

wherein the combined signal comprises a directional information of a reflected audio signal or a reverberated audio signal being reflected or reverberated in the virtual reproduction room;

wherein a time delay by which the audio source signal is delayed by the delay line is related to a distance between a virtual loudspeaker and a sound reflecting structure of the virtual reproduction room;

wherein the filter coefficients are related to a reverberation time and a diffusion characteristic of the virtual reproduction room or to a direction of sound arrival.

8. Apparatus according to claim 1, wherein the feedback processor is configured for combining the first multitude of output signals to acquire the third multitude of reverberated audio signals, wherein the feedback processor is configured for combining the first multitude of output signals based on reverberation parameters ($\alpha_{11}$-$\alpha_{44}$), the reverberation parameters being related to a reflection characteristic of a virtual reproduction room comprising a virtual audio source, the virtual audio source being associated to the audio source signal, wherein the reverberation characteristic is independent from a position of the virtual audio source in the virtual reproduction room.

9. Apparatus according to claim 8, wherein the parameters relate to a plurality of sub-rooms of the virtual reproduction room and wherein the reverberation parameters are representable in a matrix notation based on:

$$A = \begin{bmatrix} U_1 & V_1 \\ V_2 & U_2 \end{bmatrix}$$

wherein $U_1$ denotes reverberation parameters of a first sub-room, wherein $U_2$ denotes reverberation characteristics of a second sub-room, wherein $V_1$ denotes coupling parameters from the first sub-room to the second sub-room and wherein $V_2$ denotes coupling parameters from the second sub-room to the first sub-room.

10. Apparatus according to claim 8, wherein the attenuation filters comprise an infinite impulse response structure and wherein filter parameters of the infinite impulse response structure are adapted such that first reverberation characteristics of a first sub-room of the virtual reproduction room are different from second reverberation characteristics of a second sub-room of the virtual reproduction room.

11. Apparatus according to claim 1, wherein the delay network comprises a fifth multitude of equalization filters being configured for spectrally shaping the output signals, intermediate delay line signals or the combined signals to acquire a fourth multitude of loudspeaker signals being related to virtual loudspeakers of a virtual reproduction room and wherein the fourth multitude of loudspeaker signals is configured for being stored on a storage medium such that a tenth multitude of real loudspeaker signals being related to real loudspeakers of a real reproduction room (160) may be acquired by an apparatus being configured for panning the fourth multitude of loudspeaker signals to the tenth multitude of real loudspeaker signals.

12. Apparatus according to claim 1, wherein the delay line is further configured for combining at least two audio source signals and the reverberated audio signal, wherein the delay line is configured for applying a first time delay to a first audio source signal and a second time delay to a second audio source signal.

13. Apparatus according to claim 1, wherein a delay line of the second multitude of delay lines is associated to a direction of a virtual loudspeaker with respect to a virtual position of a listener in a virtual reproduction room comprising the virtual loudspeaker, wherein a distribution of virtual loudspeakers in the virtual reproduction room is unequal.

14. Sound reproduction system comprising:

an apparatus according to claim 1;

an eleventh multitude of loudspeakers; and a panner configured for receiving a fourth multitude of loudspeaker signals derived from the first multitude of output signals and for panning the fourth multitude of loudspeaker signals to a twelfth multitude of panned loudspeaker signals, the twelfth multitude of panned loudspeaker signals comprising a number of loudspeaker signals that is equal to a number of loudspeakers of the eleventh multitude of loudspeakers;unequal.

wherein the panner is configured for maintaining a sound propagation characteristic of a virtual reproduction room associated to the fourth multitude of loudspeaker signals when panning the fourth multitude of loudspeaker signals.

15. Apparatus for generating a fourth multitude of loudspeaker signals based on at least one audio source signal, the apparatus comprising:

a delay network comprising a second multitude of delay paths each delay path comprising a delay line and an attenuation filter, each delay line being configured for delaying delay line input signals and for combining the at least one audio source signal and a reverberated audio signal to acquire a combined signal, wherein the attenuation filter of a delay path is configured for filtering the combined signal from the delay line of the delay path to acquire an output signal, wherein the first multitude of output signals comprises the output signal; and a feedback processor configured for reverberating the first multitude of output signals to acquire a third multitude of the reverberated audio signals comprising the reverberated audio signal;

wherein the delay network comprises a fifth multitude of equalization filters being configured for spectrally shaping the first multitude of output signals or intermediate delay line signals to acquire the fourth multitude of loudspeaker signals, the intermediate delay line signals being received from an output tap of the delay line.

16. Apparatus according to claim 15 wherein, wherein a number of the first multitude, the second multitude, the third multitude and a fifth multitude of equalization filters is equal.

17. Apparatus according to claim 15, wherein the delay lines are associated to a direction of arrival with respect to a listening position of a reflected sound in a virtual reproduction room, wherein filter parameters of the equalization filter are adapted based on the direction of arrival.

18. Apparatus according to claim 15, further comprising a distributor configured for distributing the audio source signal into a number of versions thereof, the number of versions being at least a number of the second multitude of delay paths, the versions of the audio source signal having, with respect to each other, a delay of at most 20% of a maximum time delay of the second multitude of delay lines.

19. Apparatus according to claim 15, wherein the distributor further comprises an eighth multitude of amplifiers being configured for weighting the versions of the audio source signal to acquire weighted versions of the audio source signal, wherein the weighted versions of the audio source signal are associated to an audio signal of a virtual sound source in a virtual reproduction room comprising virtual loudspeakers and wherein a gain factor of an amplifier of the eighth multitude of amplifiers is associated to a characteristic of the reflection of the audio source in the virtual reproduction room.

20. Apparatus according to claim 15, wherein the attenuation filter comprises a ninth multitude of filter coefficients;

wherein the delay path is associated with a virtual position of a virtual loudspeaker in a virtual reproduction room having virtual sound propagating characteristics and sound reflecting structures;

wherein the filter coefficients are related to a reverberation time of the virtual reproduction room in which the audio source signal is reverberated.

21. Apparatus according to claim 15, wherein the attenuation filter comprises a ninth multitude of filter coefficients;

wherein the delay path is associated with a virtual position of a virtual loudspeaker in a virtual reproduction room having virtual sound propagating characteristics and sound reflecting structures;

wherein the combined signal comprises a directional information of a reflected audio signal or a reverberated audio signal being reflected or reverberated in the virtual reproduction room;

wherein a time delay by which the audio source signal is delayed by the delay line is related to a distance between a virtual loudspeaker and a sound reflecting structure of the virtual reproduction room;

wherein the filter coefficients are related to a reverberation time and a diffusion characteristic of the virtual reproduction room or to a direction of sound arrival.

22. Apparatus according to claim 15, wherein the feedback processor is configured for combining the first multitude of output signals to acquire the third multitude of reverberated audio signals, wherein the feedback processor is configured for combining the first multitude of output signals based on reverberation parameters, the reverberation parameters being related to a reflection characteristic of a virtual reproduction room comprising a virtual audio source, the virtual audio source being associated to the audio source signal, wherein the reverberation characteristic is independent from a position of the virtual audio source in the virtual reproduction room.

23. Apparatus according to claim 22, wherein the parameters relate to a plurality of sub-rooms of the virtual reproduction room and wherein the reverberation parameters are representable in a matrix notation based on:

$$A = \begin{bmatrix} U_1 & V_1 \\ V_2 & U_2 \end{bmatrix}$$

wherein $U_1$ denotes reverberation parameters of a first sub-room, wherein $U_2$ denotes reverberation characteristics of a second sub-room, wherein $V_1$ denotes coupling parameters from the first sub-room to the second sub-room and wherein $V_2$ denotes coupling parameters from the second sub-room to the first sub-room.

24. Apparatus according to claim 22, wherein the attenuation filters comprise an infinite impulse response structure and wherein filter parameters of the infinite impulse response structure are adapted such that first reverberation characteristics of a first sub-room of the virtual reproduction room are different from second reverberation characteristics of a second sub-room of the virtual reproduction room.

25. Apparatus according to claim 15, wherein the delay network comprises a fifth multitude of equalization filters being configured for spectrally shaping the output signals, intermediate delay line signals or the combined signals to acquire a fourth multitude of loudspeaker signals being related to virtual loudspeakers of a virtual reproduction room and wherein the fourth multitude of loudspeaker signals is configured for being stored on a storage medium such that a tenth multitude of real loudspeaker signals being related to real loudspeakers of a real reproduction room may be acquired by an apparatus being configured for panning the fourth multitude of loudspeaker signals to the tenth multitude of real loudspeaker signals.

26. Apparatus according to claim 15, wherein the delay line is further configured for combining at least two audio source signals and the reverberated audio signal, wherein the delay line is configured for applying a first time delay to a first audio source signal and a second time delay to a second audio source signal.

27. Apparatus according to claim 15, wherein a delay line of the second multitude of delay lines is associated to a direction of a virtual loudspeaker with respect to a virtual position of a listener in a virtual reproduction room comprising the virtual loudspeaker, wherein a distribution of virtual loudspeakers in the virtual reproduction room is unequal.

28. Sound reproduction system comprising:

an apparatus according to claim 15;

an eleventh multitude of loudspeakers; and a panner configured for receiving a fourth multitude of loudspeaker signals derived from the first multitude of output signals and for panning the fourth multitude of loudspeaker signals to a twelfth multitude of panned loudspeaker signals, the twelfth multitude of panned loudspeaker signals comprising a number of loudspeaker signals that is equal to a number of loudspeakers of the eleventh multitude of loudspeakers;

wherein the panner is configured for maintaining a sound propagation characteristic of a virtual reproduction room associated to the fourth multitude of loudspeaker signals when panning the fourth multitude of loudspeaker signals.

29. Method for generating a first multitude of output signals based on at least one audio source signal, the method comprising:

delaying and combining the at least one audio source signal and a reverberated audio signal with a delay line to acquire a combined signal;

filtering the combined signal from the delay line to acquire an output signal, wherein the first multitude of output signals is acquired from a second multitude of delay paths each delay path comprising a delay line; and reverberating the first multitude of output signals to acquire a third multitude of the reverberated audio signals comprising the reverberated audio signal;

wherein the combined signal comprises an audio source signal portion and a reverberated signal portion and wherein the delay line comprises a sixth multitude of input taps being configured for receiving the audio source signal or a weighted version of the audio source signal, the method comprising:

connecting the audio source signal or the weighted version of the audio source signal and one of the sixth multitude of input taps and based on a first position of a virtual audio source in a virtual reproduction room and while not connecting the audio source signal or the weighted version of the audio source signal to a different input tap of the sixth multitude of input taps, and disconnecting the audio source signal or the weighted version of the audio source signal from the one of the sixth multitude of input taps based on a second position of the virtual audio source, the second position being different from the first position; or or wherein the combined signal comprises an audio source signal portion and a reverberated signal portion and wherein the delay line comprises a seventh multitude of output taps being configured for providing the combined signal or an intermediate delay line signal, the method comprising connecting an equalization filter to the output signal or top one of the seventh multitude of output taps based on a first reflection characteristic of a virtual reproduction room, while not connecting a different output tap of the seventh multitude of output taps to the equalization filter, and disconnecting the equalization filter from the output signal or from the intermediate delay line signal based on a second reflection characteristic of the virtual production room being different from the first characteristic.

30. Method for generating a fourth multitude of loudspeaker signals based on at least one audio source signal, the method comprising:

delaying and combining the at least one audio source signal and a reverberated audio signal with a delay line to acquire a combined signal;

filtering the combined signal from the delay line to acquire an output signal, wherein the first multitude of output signals is acquired from a second multitude of delay paths each delay path comprising a delay line; and reverberating the first multitude of output signals to acquire a third multitude of the reverberated audio signals comprising the reverberated audio signal.

spectrally shaping the first multitude of output signals or intermediate delay line signals to acquire the fourth multitude of loudspeaker signals, the intermediate delay line signals being received from an output tap of the delay line;

wherein the combined signal comprises an audio source signal portion and a reverberated signal portion and wherein the delay line comprises a sixth multitude of input taps being configured for receiving the audio source signal or a weighted version of the audio source signal, the method comprising:

connecting the audio source signal or the weighted version of the audio source signal and one of the sixth multitude of input taps and based on a first position of a virtual audio source in a virtual reproduction room and while not connecting the audio source signal or the weighted version of the audio source signal to a different input tap of the sixth multitude of input taps, and disconnecting the audio source signal or the weighted version of the audio source signal from the one of the sixth multitude of input taps based on a second position of the virtual audio source, the second position being different from the first position; or or wherein the combined signal comprises an audio source signal portion and a reverberated signal portion and wherein the delay line comprises a seventh multitude of output taps being configured for providing the combined signal or an intermediate delay line signal, the method comprising connecting an equalization filter to the output signal or top one of the seventh multitude of output taps based on a first reflection characteristic of a virtual reproduction room, while not connecting a different output tap of the seventh multitude of output taps to the equalization filter, and disconnecting the equalization filter from the output signal or from the intermediate delay line signal based on a second reflection characteristic of the virtual production room being different from the first characteristic.

31. A non-transitory digital storage medium having a computer program stored thereon to perform the method for generating a first multitude of output signals based on at least one audio source signal, the method comprising:

delaying and combining the at least one audio source signal and a reverberated audio signal with a delay line to acquire a combined signal;

filtering the combined signal from the delay line to acquire an output signal, wherein the first multitude of output signals is acquired from a second multitude of delay paths each delay path comprising a delay line; and reverberating the first multitude of output signals to acquire a third multitude of the reverberated audio signals comprising the reverberated audio signal;

wherein the combined signal comprises an audio source signal portion and a reverberated signal portion and wherein the delay line comprises a sixth multitude of input taps being configured for receiving the audio source signal or a weighted version of the audio source signal, the method comprising:

connecting the audio source signal or the weighted version of the audio source signal and one of the sixth multitude of input taps and based on a first position of a virtual audio source in a virtual reproduction room and while not connecting the audio source signal or the weighted version of the audio source signal to a different input tap of the sixth multitude of input taps, and disconnecting the audio source signal or the weighted version of the audio source signal from the one of the sixth multitude of input taps based on a second position of the virtual audio source, the second position being different from the first position; or or wherein the combined signal comprises an audio source signal portion and a reverberated signal portion and wherein the delay line comprises a seventh multitude of output taps being configured for providing the combined signal or an intermediate delay line signal, the method comprising connecting an equalization filter to the output signal or top one of the seventh multitude of output taps based on a first reflection characteristic of a virtual reproduction room, while not connecting a different output tap of the seventh multitude of output taps to the equalization filter, and disconnecting the equalization filter from the output signal or from the intermediate delay line signal based on a second reflection characteristic of the virtual production room being different from the first characteristic, when said computer program is run by a computer.

32. A non-transitory digital storage medium having a computer program stored thereon to perform the method for generating a fourth multitude of loudspeaker signals based on at least one audio source signal, the method comprising:

delaying and combining the at least one audio source signal and a reverberated audio signal with a delay line to acquire a combined signal;

filtering the combined signal from the delay line to acquire an output signal, wherein the first multitude of output signals is acquired from a second multitude of delay paths each delay path comprising a delay line; and reverberating the first multitude of output signals to acquire a third multitude of the reverberated audio signals comprising the reverberated audio signal.

spectrally shaping the first multitude of output signals or intermediate delay line signals to acquire the fourth multitude of loudspeaker signals, the intermediate delay line signals being received from an output tap of the delay line;

wherein the combined signal comprises an audio source signal portion and a reverberated signal portion and wherein the delay line comprises a sixth multitude of input taps being configured for receiving the audio source signal or a weighted version of the audio source signal, the method comprising:

connecting the audio source signal or the weighted version of the audio source signal and one of the sixth multitude of input taps and based on a first position of a virtual audio source in a virtual reproduction room and while not connecting the audio source signal or the weighted version of the audio source signal to a different input tap of the sixth multitude of input taps, and disconnecting the audio source signal or the weighted version of the audio source signal from the one of the sixth multitude of input taps based on a second position of the virtual audio source, the second position being different from the first position; or or wherein the combined signal comprises an audio source signal portion and a reverberated signal portion and wherein the delay line comprises a seventh multitude of output taps being configured for providing the combined signal or an intermediate delay line signal, the method comprising connecting an equalization filter to the output signal or top one of the seventh multitude of output taps based on a first reflection characteristic of a virtual reproduction room, while not connecting a different output tap of the seventh multitude of output taps to the equalization filter, and disconnecting the equalization filter from the output signal or from the intermediate delay line signal based on a second reflection characteristic of the virtual production room being different from the first characteristic, when said computer program is run by a computer.

* * * * *